United States Patent [19]

Steiger et al.

[11] 4,376,817

[45] Mar. 15, 1983

[54] DIRECT-POSITIVE PHOTOGRAPHIC MATERIAL

[75] Inventors: Rolf Steiger, Praroman; Jean F. Reber, Marly, both of Switzerland

[73] Assignee: Ciba-Geigy AG, Basel, Switzerland

[21] Appl. No.: 287,323

[22] Filed: Jul. 27, 1981

Related U.S. Application Data

[63] Continuation of Ser. No. 70,476, Aug. 28, 1979, abandoned.

[30] Foreign Application Priority Data

Sep. 1, 1978 [CH] Switzerland ..... 9254/78
Apr. 5, 1979 [CH] Switzerland ..... 3189/79
Apr. 5, 1979 [CH] Switzerland ..... 3190/79

[51] Int. Cl.[3] ..... G03C 1/10

[52] U.S. Cl. ..... 430/578; 430/596; 430/597; 430/411; 430/412; 430/573; 430/574; 430/576; 430/588; 430/589

[58] Field of Search ..... 430/578, 597, 596, 411, 430/412, 573, 574, 576, 588, 589

[56] References Cited

U.S. PATENT DOCUMENTS

Re. 29,930 3/1979 Illingsworth ..... 430/597
2,282,115 3/1939 Brooker et al. ..... 430/578
3,501,306 3/1970 Illingsworth ..... 430/598

FOREIGN PATENT DOCUMENTS 549203 3/1943 United Kingdom ..... 430/578
549204 3/1943 United Kingdom ..... 430/578

*Primary Examiner*—Won H. Louie, Jr.
*Attorney, Agent, or Firm*—Joseph G. Kolodny

[57] ABSTRACT

Direct-positive photographic material having at least one layer which contains a silver halide emulsion surface-fogged by chemical means or by exposure and a tri-nuclear cyanine dye, which has the formula (1)

(2)

(3)

(4)

(5)

in which $A_1$ is =CH— or =CH—CH=CH—, $Z_1$ is a monocyclic or polycyclic heterocyclic radical which is linked by a double bond to the adjacent methine group, $Z^{\oplus}$ is a positively charged radical which is mesomeric to $Z_1$ and is linked by a single bond to the adjacent methine group, $Z_2$—is a nitrogen-heterocyclic radical which has its single positive charge on the nitrogen atom and $Z_3$= is a radical which has no charge on the nitrogen atom and is mesomeric to $Z_2$, at least one of the radicals $Z_2$ containing a betain-type structure and it being possible for the cyanine dyes of the formulae (4) and (5) to have a neutral or positive or negative charge, corresponding to the sum of the charges, the positively or negatively charged dyes containing a corresponding counter-ion, and $X^{\ominus}$ is a monovalent anion and $Y^{\ominus\ominus}$ is a divalent anion.

If desired, the tri-nuclear cyanine dyes are used together with conventional cyanine dyes. The direct-positive material possesses excellent sensitivity in the long-wave region of the visible spectrum.

8 Claims, 3 Drawing Figures

DIRECT-POSITIVE PHOTOGRAPHIC MATERIAL

Figure 1:
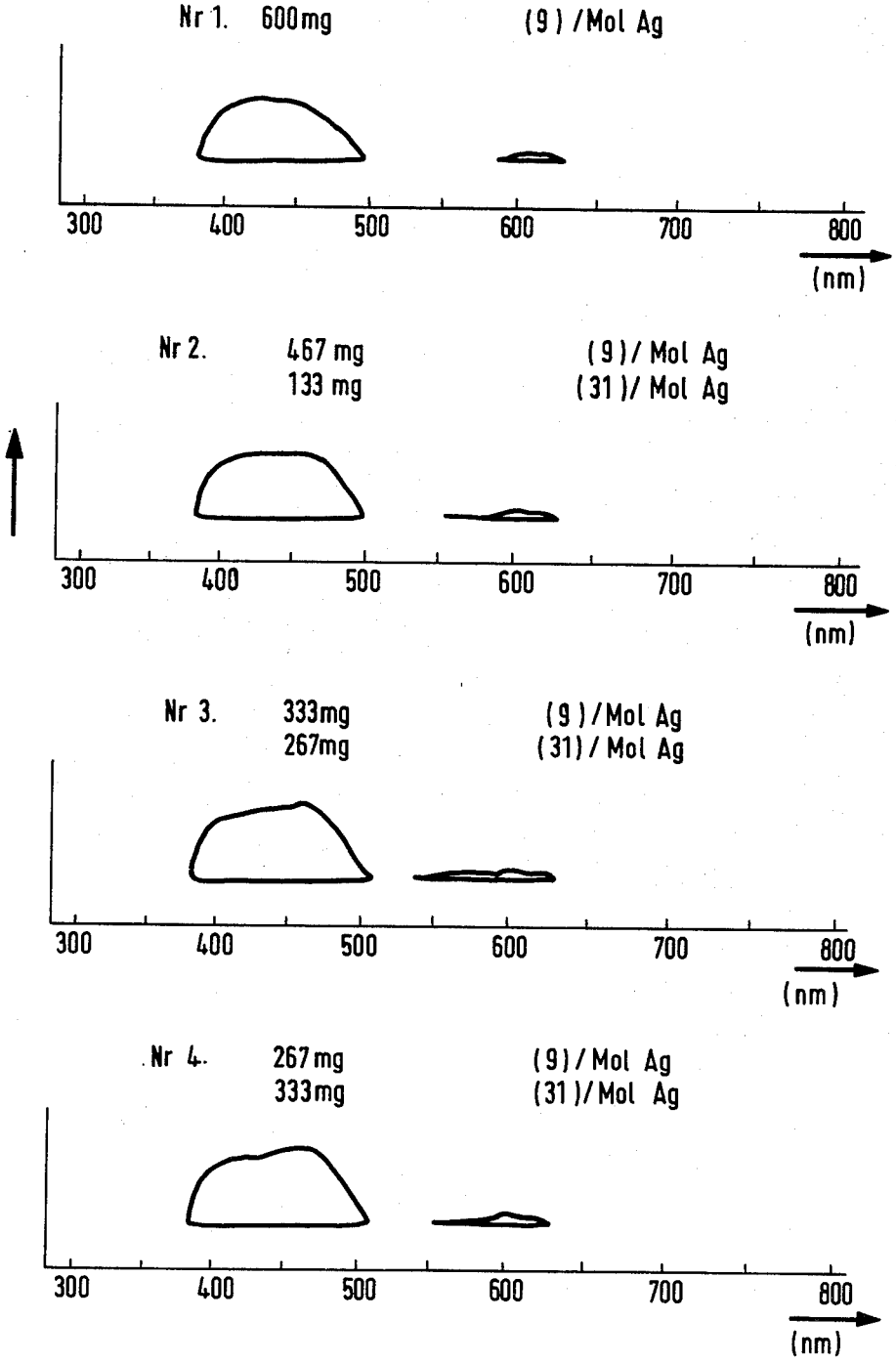

This is a continuation of application Ser. No. 070,476, filed Aug. 29, 1979, now abandoned.

The present invention relates to direct-positive photographic material having at least one layer which contains a silver halide emulsion surface-fogged by chemical means or by exposure and a cyanine dye. New sensitisers and combinations of sensitisers with particularly advantageous properties are proposed for emulsions of this type, which are known per se.

It is known that fogged silver halide emulsions on the surface of which an electron acceptor has been adsorbed are suitable for the production of direct-positive photographic materials. Such direct-positive emulsions and the photographic materials produced therefrom have been disclosed in numerous patent publications, for example in U.S. Pat. Nos. 3,501,306, 3,501,307, 3,501,309, 3,501,310, 3,501,311, 3,501,312, 3,782,959, 3,804,632, 3,826,656, 3,923,524, 3,925,085, 3,933,505 and 3,933,506. A particular advantage of these known photographic emulsions is that the photographic materials produced therefrom show virtually no residual fog at the strongly exposed image areas, so that images with pure image whites can be produced. On the other hand, emulsions of this type, and the photographic materials produced therefrom, have, however, the disadvantage that they have only a low sensitivity towards the long-wave constituents of visible light, especially in the green and red part of the spectrum.

There has, therefore, been no lack of attempts to improve the sensitivity of such direct-positive systems, and in particular to find suitable electron acceptors which can render the silver halide crystals sensitive to longer-wave light also. Thus, for example U.S. Pat. No. 3,583,870 describes the use of a sensitising mixture of bis-pyridinium salts and sensitiser dyes from the category of the methine and azocyanine dyes. Similar effects are also said to be achieved with the carbocyanines having one or two indolenine nuclei, which are described in U.S. Pat. No. 3,970,461.

The object of the present invention is to provide novel direct-positive, fogged silver halide emulsions which, due to the use of novel sensitisers or sensitiser mixtures, have an improved sensitivity in the long-wave regions of visible light and are thus suitable for overcoming the said disadvantages of direct-positive photographic materials to a substantial extent.

It has now been found that direct-positive photographic materials with good sensitivity, especially also in the green and red region of the spectrum, can be produced when silver halide emulsion fogged in the customary manner is mixed with tri-nuclear cyanine dyes and this emulsion is used as a layer in the said material. The tri-nuclear cyanine dyes contain three heterocyclic rings (ring system), which are identical (and can be in the mesomeric form) and which if desired contain different substituents.

The present invention relates to a direct-positive photographic material having at least one layer which contains a silver halide emulsion surface-fogged by chemical means or by exposure and a cyanine dye, wherein the cyanine dye is a tri-nuclear cyanine dye with three identical heterocyclic ring systems, which can have different substituents (on the nitrogen atoms of the preferably used nitrogen containing heterocyclic rings). The methine systems also are identical and these are necessarily in the mesomeric forms. Particularly suitable tri-nuclear cyanine dyes have the formulae

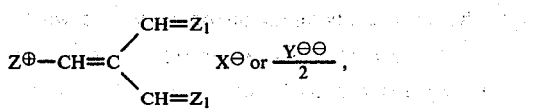

(1)

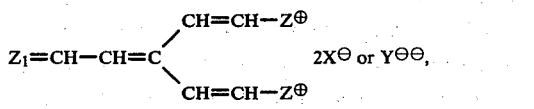

(2)

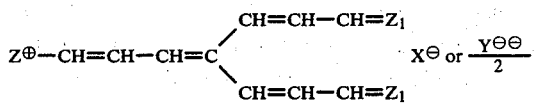

(3)

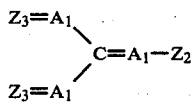

(4)

or

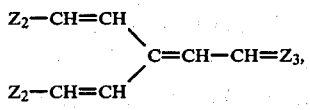

(5)

in which $A_1$ is =CH— or =CH—CH=CH—, $Z_1$ is a monocyclic or polycyclic heterocyclic radical which is linked by a double bond to the adjacent methine group, $Z^{\oplus}$ is a positively charged radical which is mesomeric to $Z_1$ and is linked by a single bond to the adjacent methine group, $Z_2$— is a nitrogen-heterocyclic radical which has its single positive charge on the nitrogen atom and $Z_3$= is a radical which has no charge on the nitrogen atom and is mesomeric to $Z_2$, at least one of the radicals $Z_2$ containing a betain-type structure and it being possible for the cyanine dyes of the formulae (4) and (5) to have a neutral or positive or negative charge, corresponding to the sum of the charges, the positively or negatively charged dyes containing a corresponding counter-ion, and $X^{\ominus}$ is a monovalent anion and $Y^{\ominus\ominus}$ is a divalent anion.

The cyanine dyes of the formulae (1) to (3) are tri-nuclear cyanine dyes, in which the heterocyclic ring systems (including the substituents) are identical (except for possible mesomeric structures). The cyanine dyes of the formulae (1) to (3) contain no betain structures. The tri-nuclear cyanine dyes of the formulae (4) and (5) contain three identical heterocyclic ring systems, which can contain different substituents (on the nitrogen atoms of the heterocyclic rings) and contain at least one betain structure.

The present invention also relates to the use of the photographic material for the production of direct-positive images and to the process for the production of direct-positive images by image-wise exposure and developing of the material.

Suitable monocyclic or polycyclic, heterocyclic ring systems $Z_2$ (or $Z_3$) are, in particular, those with 1 to 4, preferably fused, nitrogen-heterocyclic rings, of which at least one ring contains a nitrogen atom which is part of a betain-type structure. Ring systems containing 5-membered and/or 6-membered rings are preferred. They can be unsubstituted or substituted, for example by alkyl ($C_1$–$C_4$), especially methyl, aryl, especially phenyl, or halogenoalkyl ($C_1$–$C_4$), especially trifluoromethyl. The substituents on the nitrogen atom or atoms which is or are a part of the betain-type structure or structures are, for example, sulfo- and carboxy-alkyl radicals having 1 to 20 and preferably 1 to 4 carbon atoms in the alkyl moiety, and also sulfo- and carboxy-aryl or -aralkyl, in which aryl and aralkyl are preferably phenyl, benzyl or phenylethyl. The substituents on further nitrogen atoms can be alkyl having 1 to 20 and especially having 1 to 4 carbon atoms, and also alkenyl having, for example, 2 to 10 carbon atoms, or aryl and aralkyl radicals, such as, in particular, phenyl, benzyl or phenylethyl. The said alkyl or alkenyl radicals can be further substituted, for example by halogen (fluorine, chlorine or bromine), hydroxyl, cyano, alkoxy having 1 to 4 carbon atoms or carbalkoxy having 1 to 4 carbon atoms in the alkoxy radical, carboxyl (COOH or $COO^{\ominus}$) or the sulfo group ($—SO_3H$ or $—SO_3^{\ominus}$); the substituents on phenyl or benzyl can be the same substituents and also alkyl, hydroxyalkyl or halogenoalkyl, each having 1 to 4 carbon atoms, as well as $—NH_2$, $—CONH_2$ or $—SO_2NH_2$, which can also be substituted by alkyl ($C_1$–$C_4$) on the nitrogen atom.

Particularly preferred tri-nuclear cyanine dyes of the formulae (4) and (5), which can be positively charged, negatively charged (anionic) or zwitterionic (betain structure), have the formulae

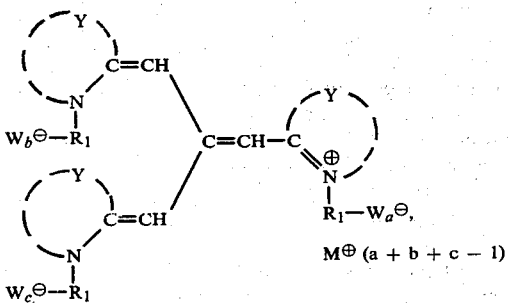

(6)

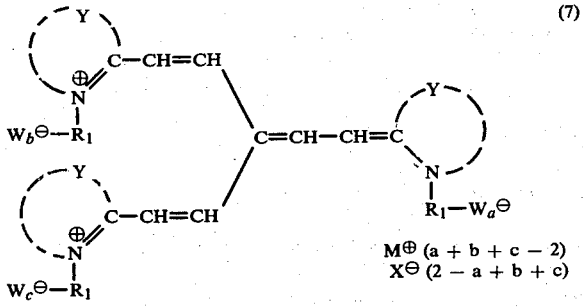

(7)

or

-continued

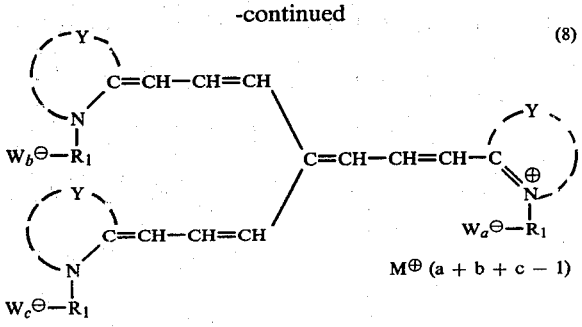

(8)

in which Y represents the atoms necessary to complete the mono- or poly-heterocyclic ring system, $R_1$ in each case is a substituted or unsubstituted alkyl having 1 to 20 carbon atoms, aryl or aralkyl (if $W^{\ominus}$ is not present), substituted or unsubstituted alkylene having 1 to 20 carbon atoms or substituted or unsubstituted aryl or aralkyl, $W^{\ominus}$ is a sulfo or carboxyl group, $M^{\oplus}$ is a monovalent cation, $X^{\ominus}$ is a monovalent anion and a, b and c are each the number 0 or 1, one of these indices being 1.

Preferred substituents $R_1$ or $R_1$—$W^{\ominus}$— in the compounds of the formulae (6) to (8) are methyl, ethyl, n-propyl, n-butyl, iso-butyl, allyl, β-methylallyl, β-methoxyethyl, β-ethoxyethyl, β-hydroxyethyl, γ-hydroxypropyl, benzyl, β-phenylethyl, carboxymethyl, carboxyethyl, carboxypropyl, carboxybutyl, sulfoethyl, sulfopropyl, sulfobutyl, p-sulfobenzyl, carbomethoxymethyl or -ethyl or carboethoxy-methyl or -ethyl.

The monocyclic or polycyclic heterocyclic radicals Z and $Z_1$ in the cyanine dyes of the formulae (1) to (3) are preferably nitrogen-hterocyclic radicals, which can be substituted. Preferred suitable radicals are those of the following formulae, in which $R_1'$ is substituted or unsubstituted alkyl, preferably having 1 to 20 and in particular having 1 to 4 carbon atoms, or substituted or unsubstituted aryl, especially phenyl.

Substituents on the alkyl radical can be, for example, halogen, hydroxyl or cyano, and substituents on the phenyl can also be, in addition to those mentioned, alkyl, hydroxyalkyl or halogenoalkyl, each having 1 to 4 carbon atoms, and also $—NH_2$, $—CONH_2$ or $—SO_2NH_2$, which can also be substituted by alkyl ($C_1$–$C_4$) on the nitrogen atom.

Preferred heterocyclic ring systems are indicated by the formulae given below. For reasons of simplicity, only one mesomeric structure is indicated in each case. $R_1$ is as defined and, according to the definition, the defined meaning also applies in the case of $R_1'$ or in the case of the betain structures $R_1W^-$.

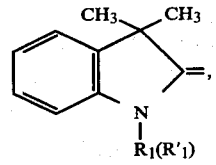

especially

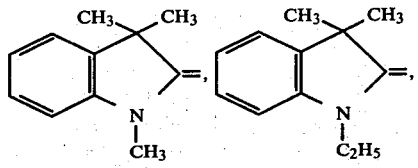

-continued
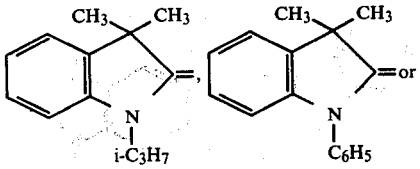
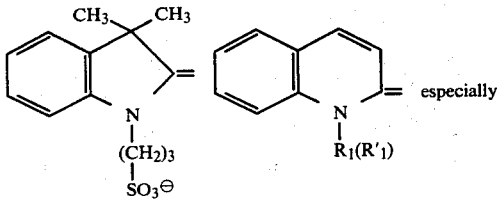
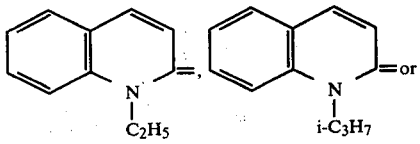
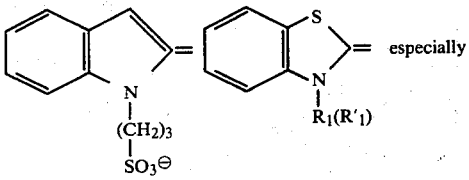
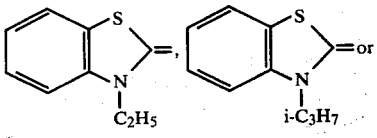
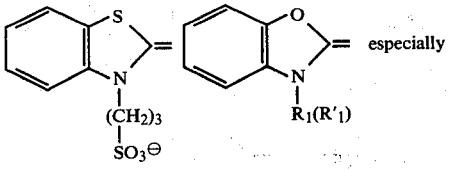
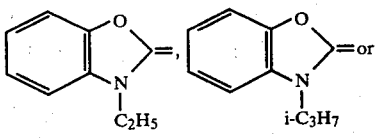
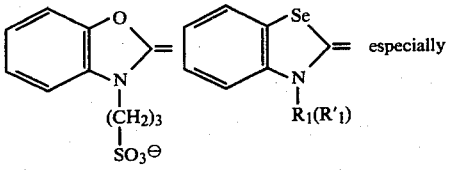
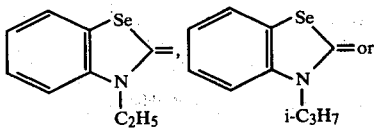
-continued
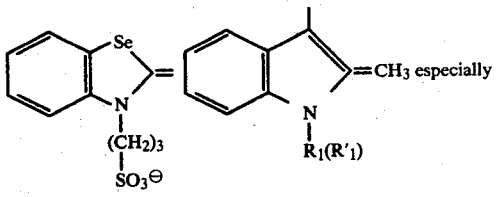
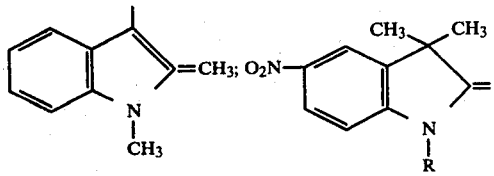
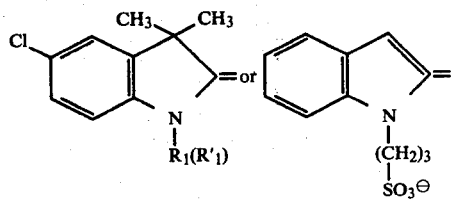
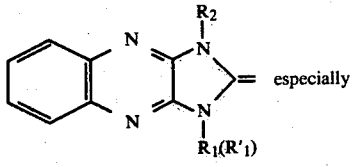
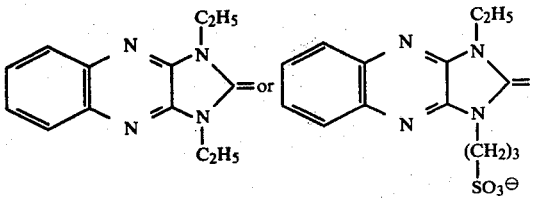
($R_2$ = alkyl having 1 to 4 carbon atoms)
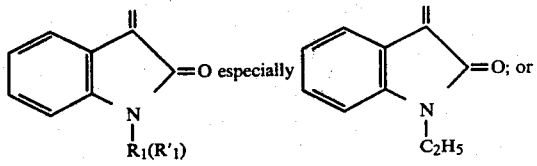
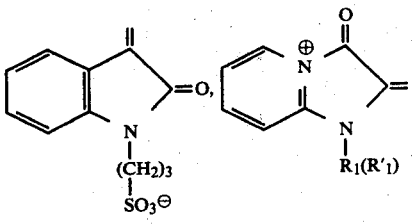
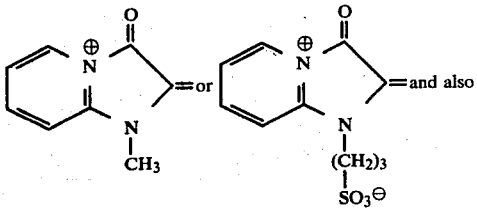

-continued
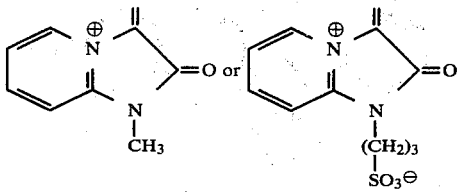
In the above heterocyclic radicals, it is also possible to insert $R_1W^-$ for the betain structure in place of $R_1$ and $R_1'$. Further suitable heterocyclic radicals have the following formulae:
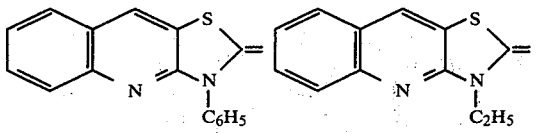
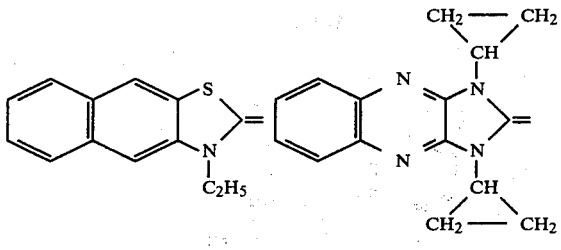
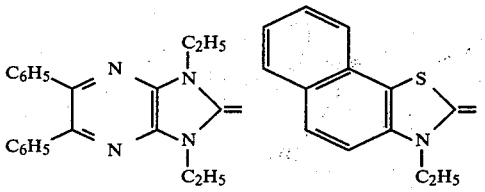
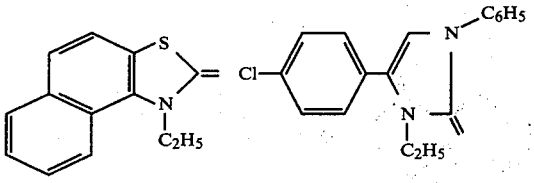
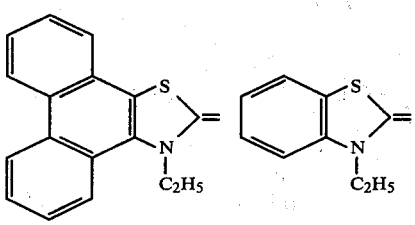
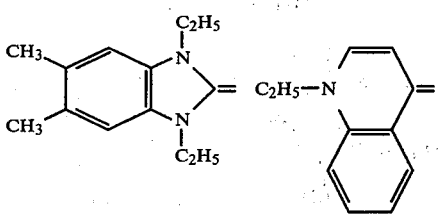
-continued
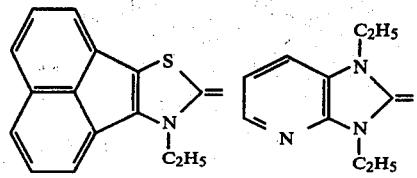
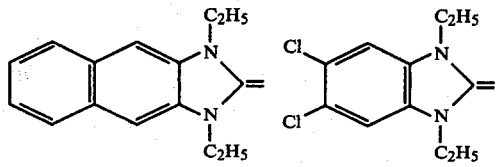
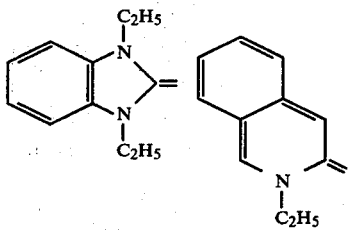
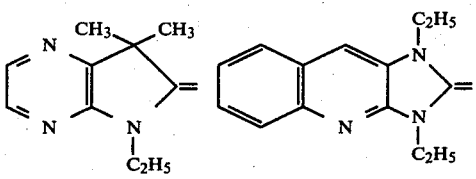
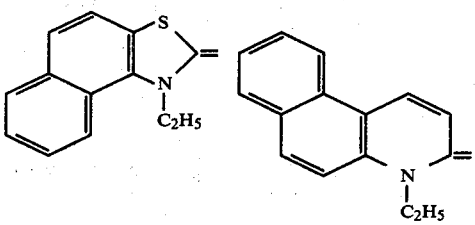
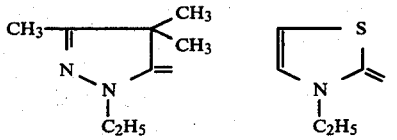
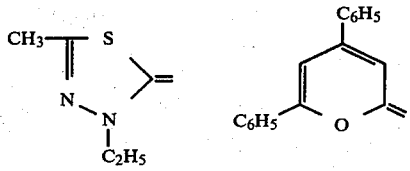
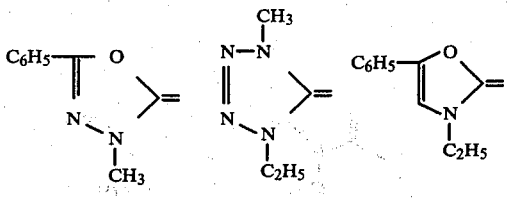

-continued

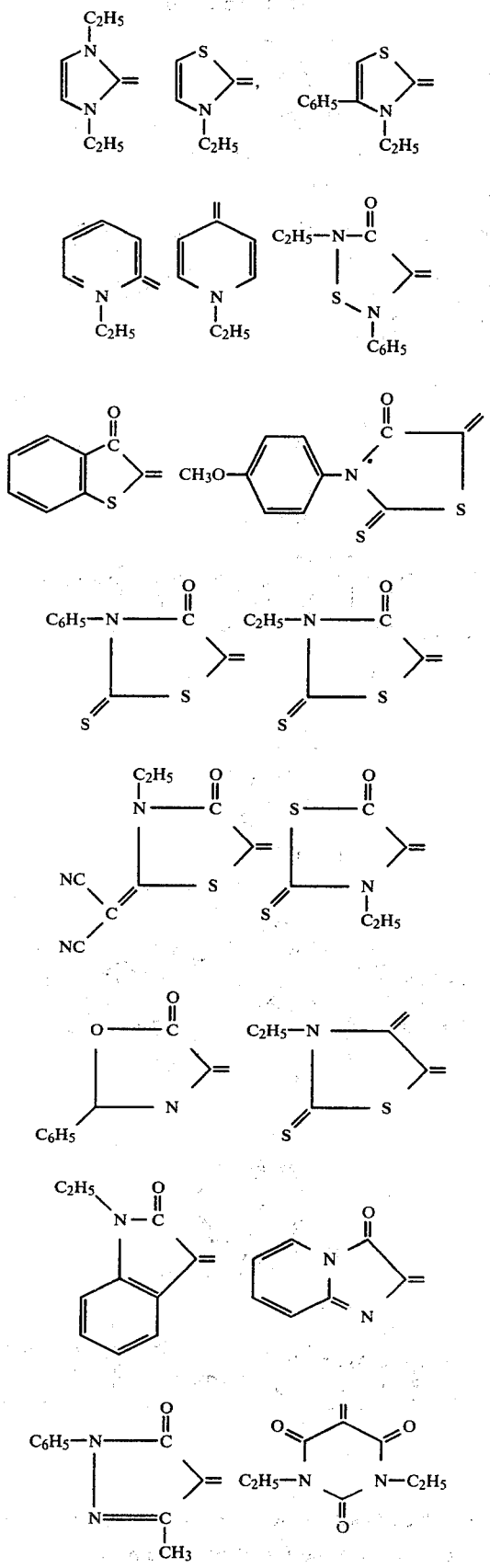

-continued

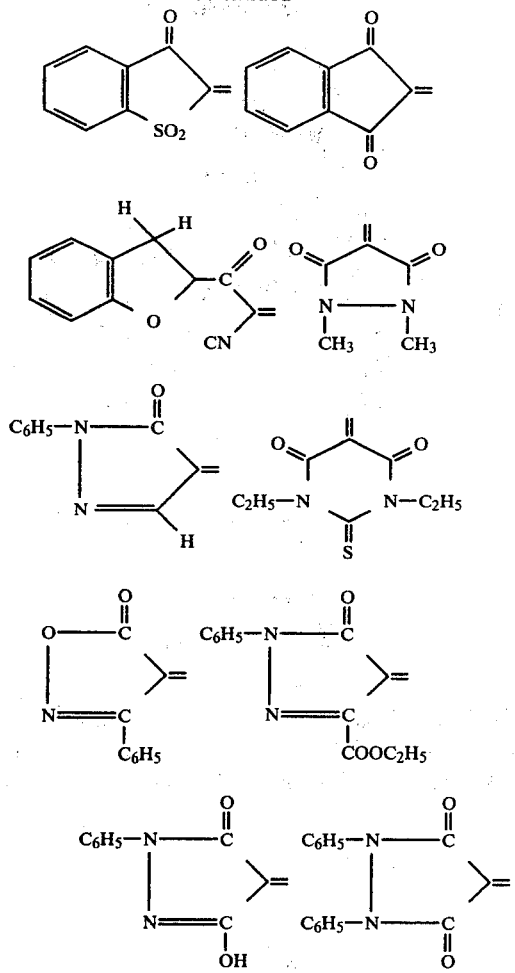

These further heterocyclic radicals which have been given can, of course, also contain betain structures.

The heterocyclic compounds which are suitable for the preparation of cyanine dyes are known, for example, from D. M. Sturmer, Syntheses and Properties of Cyanine and Related Dyes in Chemistry of Heterocyclic Compounds, volume 30, (1977), edited by A. Weissberger and E. C. Taylor.

Particularly preferred tri-nuclear cyanine dyes of the formulae (1) to (3) have the formulae (9)

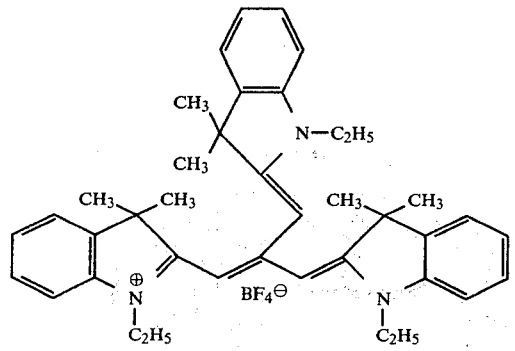

-continued
(10)
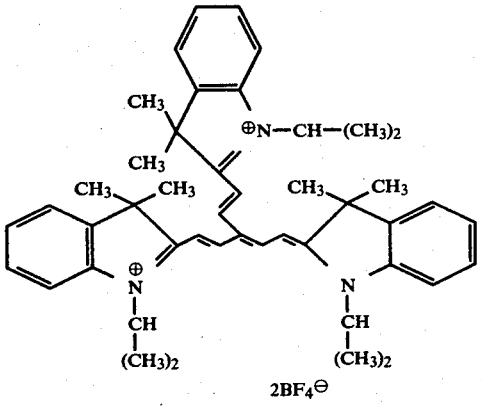
(11)
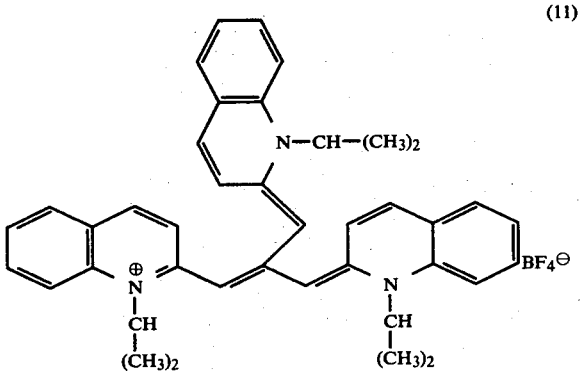
(12)
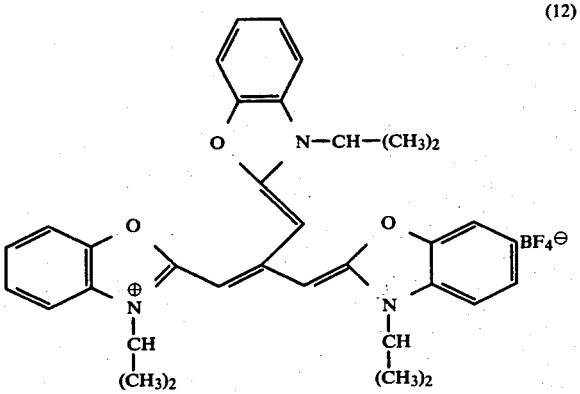
(13)
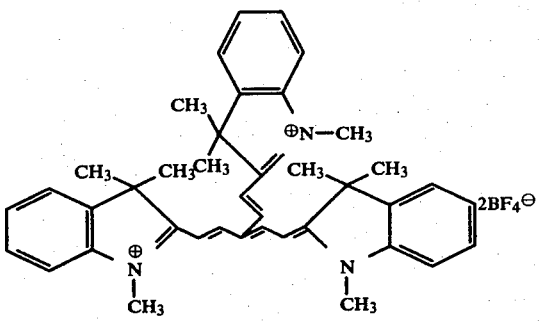
-continued
(14)
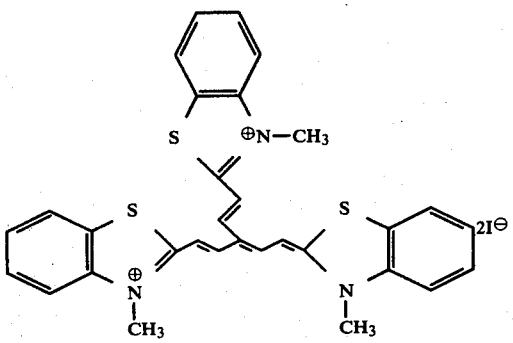
(15)
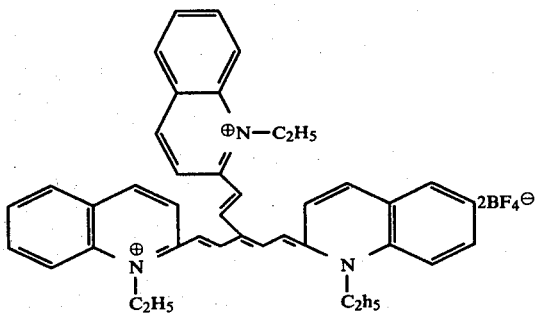
(16)
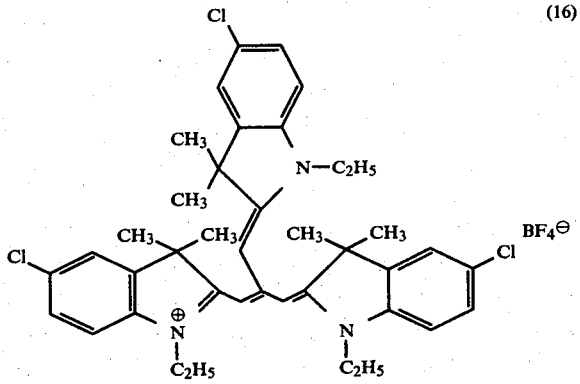
(17)
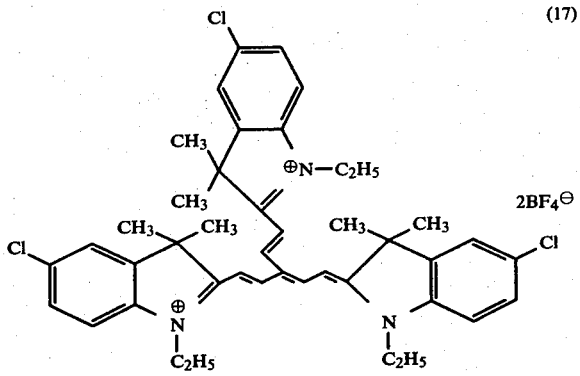
Particularly preferred tri-nuclear cyanine dyes of the formulae (4) and (5) have the formulae (18)

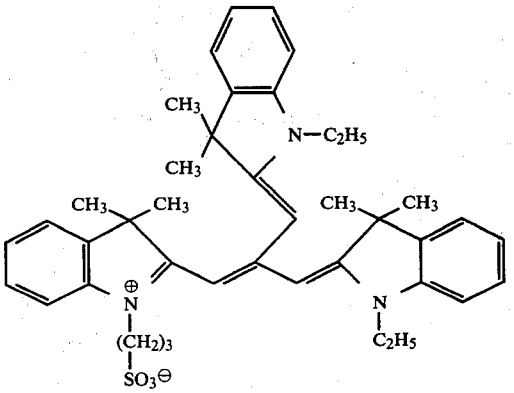

(19)

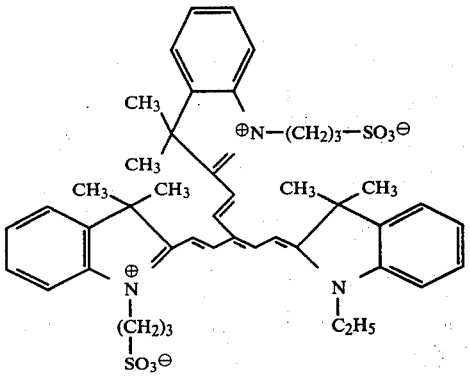

(20)

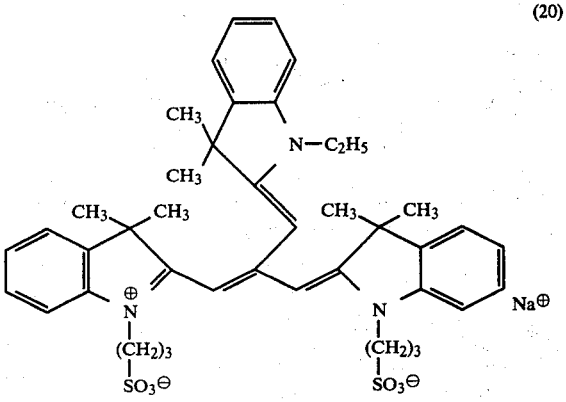

(21)

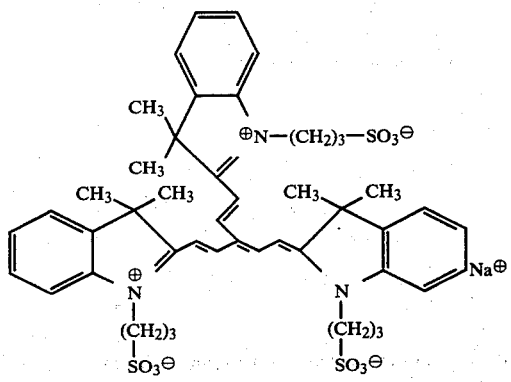

-continued (22)

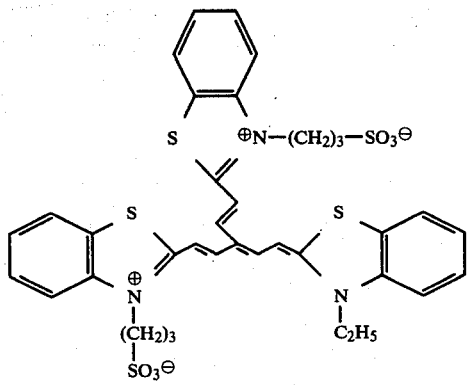

(23)

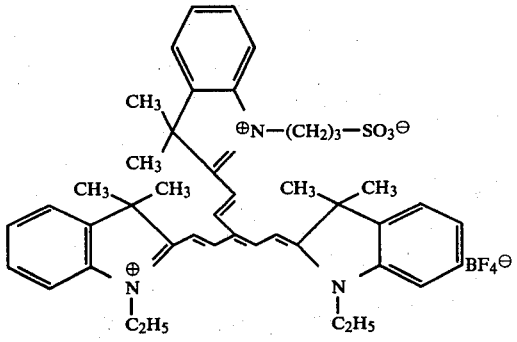

The anions $X^{\ominus}$ and $Y^{\ominus\ominus}$ in the compounds of the formulae (1) to (3) and the anion $X^{\ominus}$ in the compounds of the formula (7) can be, in particular, the halides, such as chloride, bromide or iodide, and also nitrate, tetrafluoroborate, perchlorate, thiocyanate and p-toluenesulfonate, as well as hydrogen sulfate and sulfate.

The monovalent cations ($M^{\oplus}$ in the compounds of the formulae (6) to (8)) are, for example, hydrogen, alkali metal cations (sodium or potassium), ammonium or substituted ammonium.

The synthesis and the properties of tri-nuclear cyanine dyes are described in C. Reichhardt and W. Mormann, Chem. Ber. 105, 1815 (1972); C. Reichhardt and K. Halbritter, Chem. Ber. 104, 822 (1971); F. Baer and H. Oehling, Org. Magnet, Resonance 6, 421 (1974); and C. Reichhardt, Tetrahedron Letters 1967, 4327.

Tri-nuclear tetramethine cyanine dyes which are comparable with the tetramethine cyanines of the present invention are also described in U.S. Pat. No. 2,282,115 and in British Patent Specifications Nos. 549,203 and 549,204. It can be seen from the last two patent specifications that tri-nuclear cyanines of the type used according to the invention have poor to at most moderate sensitising characteristics in normal negative photographic systems. It is therefore surprising that they result in relatively highly sensitive systems when used according to the invention in direct-positive fogged emulsions.

The sensitivity of the direct-positive photographic materials according to the invention can be further increased by adding, in addition to the tri-nuclear cyanine dyes mentioned, yet further conventional sensitising dyes other than the tri-nuclear cyanine dyes.

Dyes which are suitable as further sensitising dyes are, for example, the conventional mono- or polymethine dyes, such as acid or basic cyanines, hemicyanines, streptocyanines, merocyanines, oxonoles, hemioxonoles or styryl dyes. Sensitisers of this type are described, for example, by F. M. Hamer in "The Cyanine Dyes and Related Compounds" (1964), Interscience Publishers John Wiley and Sons.

Preferred cyanine dyes are acid or basic, as a rule bi-nuclear, symmetrical cyanine dyes, which contain substituted or unsubstituted benzimidazole, benzoxazole, benzothiazole, benzselenazole, indole and/or quinoline radicals. Substituents on these heterocyclic radicals can be alkyl having 1 to 18 carbon atoms, halogen, especially chlorine and bromine, amino, alkylamino having 1 to 4 carbon atoms, alkoxyalkyl having 1 to 4 carbon atoms in the alkyl moiety and in the alkoxy moiety, halogenoalkyl having 1 to 4 carbon atoms, for example trifluoromethyl, nitro, aryl, especially phenyl, carboxyalkyl having 1 to 4 carbon atoms in the alkyl moiety and sulfoalkyl having 1 to 4 carbon atoms in the alkyl moiety. The following are specific examples of cyanine dyes which are suitable as additional sensitising dyes:

(24)

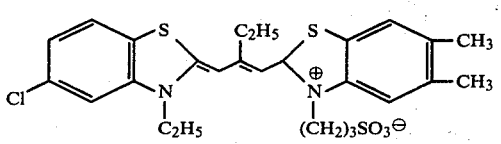

Absorption maximum in the emulsion: 650 nm (aggregated, J-band)

(25)

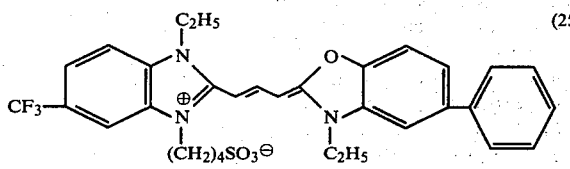

Absorption maximum in the emulsion: 525 nm (monomer)

(26)

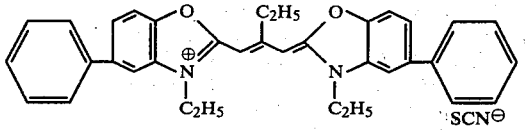

Absorption maximum in the emulsion: 555 nm (aggregated, J-band)

(27)

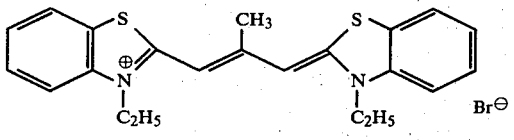

Absorption maximum in the emulsion: 570 nm (monomer), 520 nm (dimer), 595 nm (J-band)

(28)

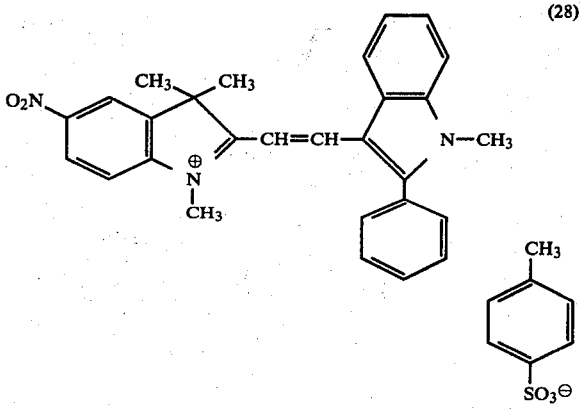

Absorption maximum in the emulsion: 560 nm (monomer)

(29)

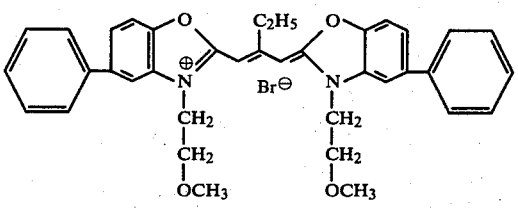

Absorption maximum in the emulsion: 555 nm (aggregated, J-band)

(30)

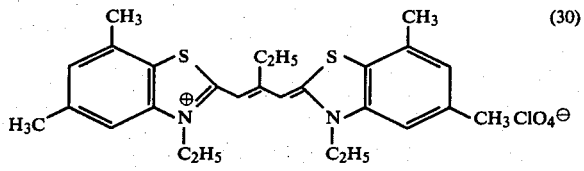

Absorption maximum in the emulsion: 580 nm (monomer), 650 nm (aggregated, J-band)

(31)

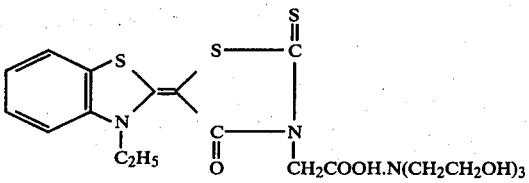

Absorption maximum in the emulsion: 465 nm (monomer)

(32)

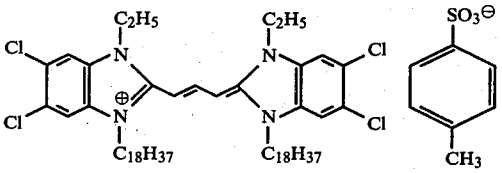

Absorption maximum in the emulsion: 520 nm (monomer), 595 nm (J-band)

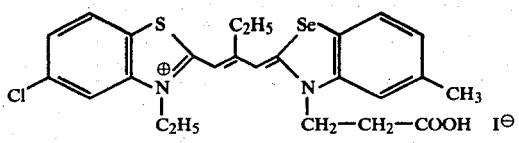

(33)

Absorption maximum in the emulsion: 650 nm (J-band)

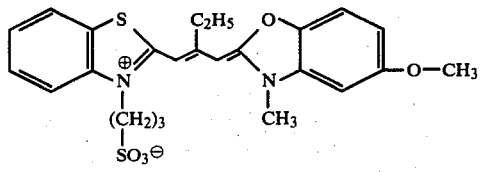

(34)

Absorption maximum in emulsion: 595 nm (J-band)

Together with the tri-nuclear cyanine dyes, the sensitising dyes additionally used can produce two fundamentally different effects:

(a) Normal additional sensitising: by the addition of the second sensitiser, the sensitivity of the emulsion is increased in the wavelength range of this additional sensitiser. The sensitivity in the wavelength ranges of the tri-nuclear cyanine remains virtually unchanged.

(b) Supersensitising: by the addition of a second sensitiser, the original sensitisation curve of the tri-nuclear cyanine dye is raised in its own characteristic ranges.

Figure 2:
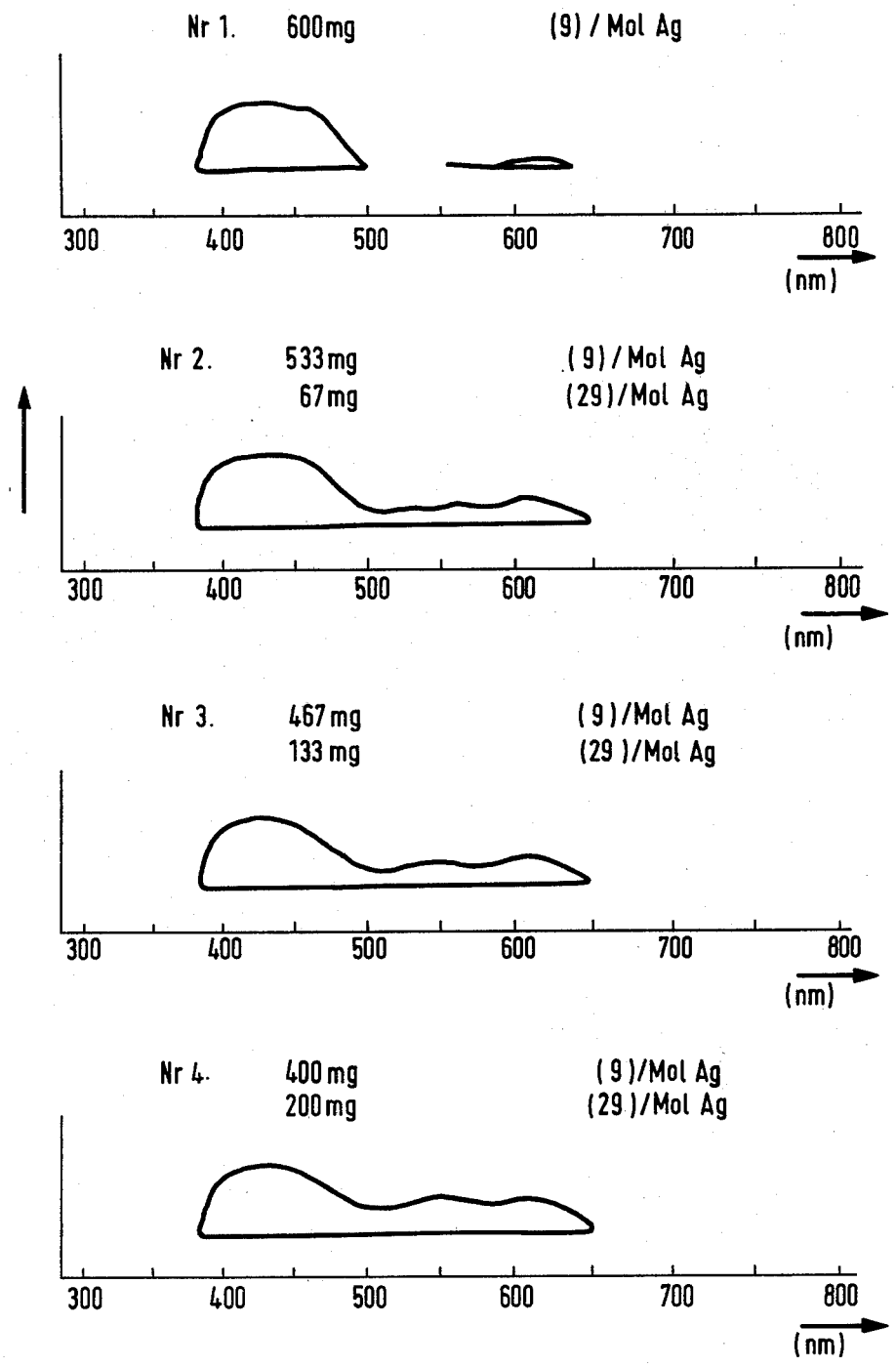
Figure 2:
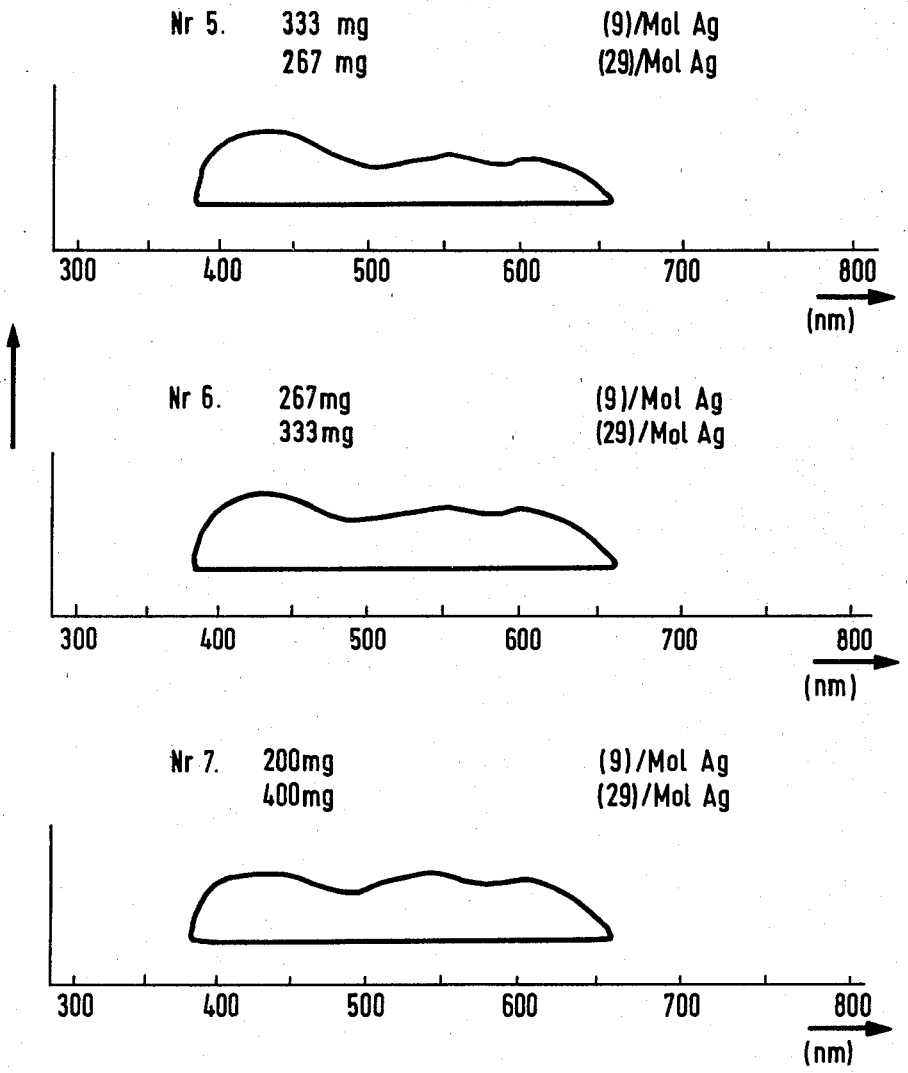

The relationships are illustrated by the spectro-sensitograms of FIGS. 1 and 2. FIG. 1 shows spectro-sensitograms of a direct-positive emulsion according to the present invention, which has been additionally sensitised with the cyanine dye of the formula (31). The total amount of the two sensitisers is kept constant at 600 mg per mol of silver. As the amount of the tri-nuclear cyanine falls and the amount of the additional sensitiser increases, an increase is observed only in the sensitivity in the spectral range around 467 nm; the sensitivity in the other ranges, in particular the longer wavelength ranges, remains virtually constant.

FIG. 2 illustrates the effect of a supersensitiser. As in FIG. 1, the total amount of the two sensitising dyes is kept constant at 600 mg per mol of silver in the emulsion. As the proportion of the second cyanine dye of the formula (29), which is acting as the supersensitiser, increases, an increasing sensitivity is observed in the longer wavelength ranges, i.e. those ranges in which the tri-nuclear cyanine dye itself already has a weak sensitising action.

Figure 3:
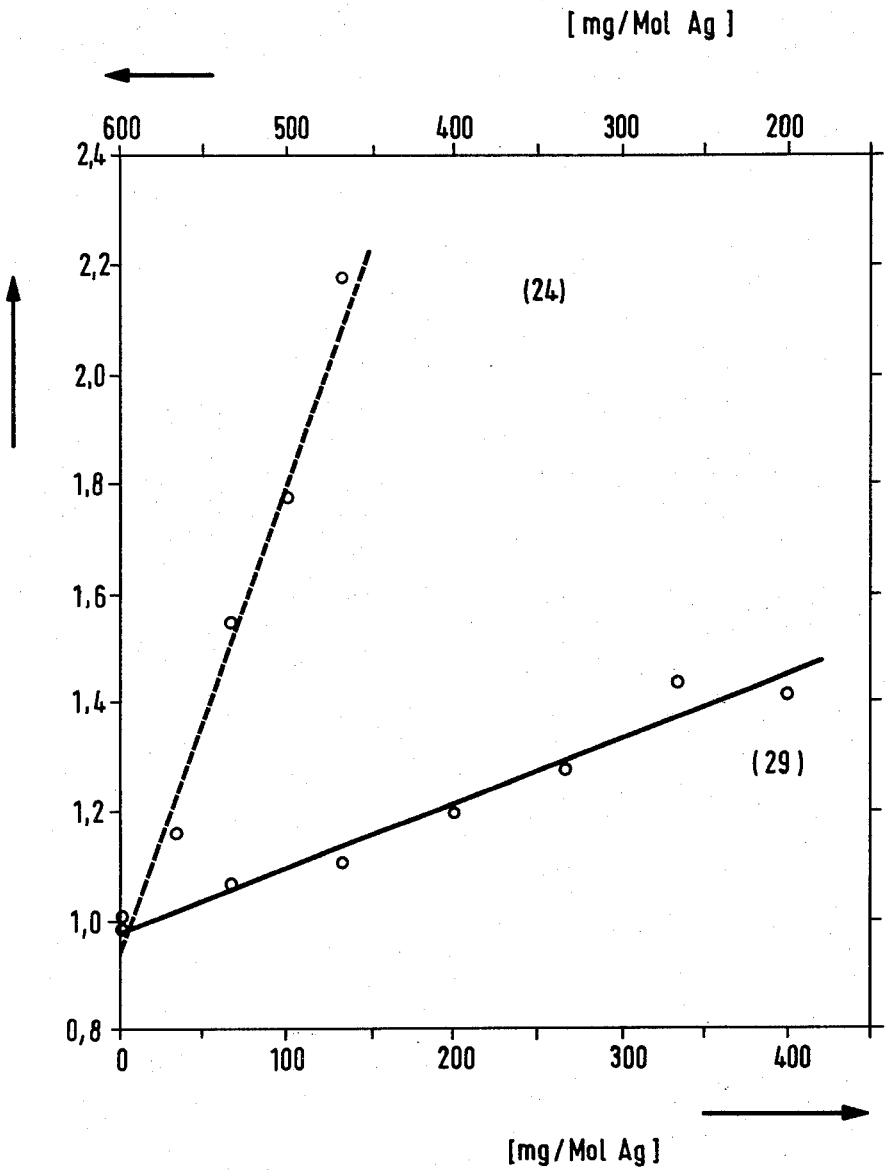

FIG. 3 shows that a considerable increase in the sensitivity can be achieved with an increasing concentration of the additional dye.

Hitherto there has been no theory which can be used reliably to predict the supersensitising action of an additional sensitising dye in a system, according to the invention, containing a tri-nuclear cyanine dye. However, it has been found that, as a rule of virtually general validity, the polarographically determined anodic half-wave potential of the second sensitising dye should be lower than that of the tri-nuclear cyanine dye if additional sensitising is to occur at all. In most cases, the sensitising is supersensitising; in some cases, however, only a normal additional sensitisation in the wavelength range of the second sensitiser has been found. If the anodic half-wave potential of the additional sensitising dye is greater than that of the tri-nuclear cyanine dye, no additional sensitisation takes place. The anodic half-wave potential is determined, for example, by the method described by R. F. Lange in "Photographic Sensitivity" (Proc. Photographic Sensitivity Symposium, Cambridge 1972, and R. J. Cox et. al., Academic Press, London 1973, page 241).

A supersensitising effect arises, in particular, when the cyaning dyes additionally used tend to form aggregates. Such aggregates are described, for example, in T. H. James "The Theory of the Photographic Process", page 218 to 222, 4th edition, 1977, McMillan Publishing Co. In general, the aggregates have absorption bands in a longer wavelength range than the molecular bands of the dye in the monomeric state. The so-called J-aggregates, which also display resonance fluorescence in addition to the longer wavelength absorption band, are of particular importance in practice.

The particular advantages of the direct-positive emulsions according to the invention, and of the tri-nuclear cyanines used to prepare these emulsions, are:

1. The sensitised emulsions have little characteristic colour.

2. The tri-nuclear cyanine dyes can be used directly as positively acting sensitising dyes in emulsions containing fogged silver halide crystals.

3. The tri-nuclear cyanine dyes are readily compatible with other spectral sensitising dyes and, depending on the properties of the additional sensitising dye, normal sensitisation in a characteristic range of the additional sensitising dye or supersensitisation in the characteristic range of the tri-nuclear cyanine dye is obtained.

4. Excellent photographic characteristics, in particular a high maximum density and a very small minimum density.

The emulsions which can be used for the invention are the conventional photographic emulsions consisting of silver chloride, silver bromide or silver iodide as well as mixtures of these halides; the proportions of the different halides can vary within wide limits. Suitable emulsions are described, for example, in U.S. Pat. Nos. 3,501,305, 3,501,306, 3,531,288 and 3,501,290. In addition, vapour-deposited layers of silver halide on suitable supports can also be processed according to the invention to give direct-positive materials.

The surface-fogging of the silver halide can be effected, for example, by exposure or by chemical means using the conventional fogging agents, for example using reducing agents, such as sodium formaldehyde-sulfoxylate, hydrazine, tin-II salts or thiourea dioxide. It is particularly advantageous to use, at the same time, a reducing agent together with a metal which is more noble than silver, for example rhodium, gold and the like, as is described, for example, in T. H. James "The Theory of the Photographic Process", page 189, 4th edition, 1977 or in U.S. Pat. No. 3,501,307.

In order to produce photographic materials, the fogged emulsions provided, according to the invention, with a tri-nuclear cyanine dye and also, if desired, with further spectral sensitising dyes, are coated in a thin layer onto a suitable substrate made of glass, paper or plastic, it being possible to add further conventional assistants, for example stabilisers, wetting agents, hardeners, plasticisers, hydrophilic colloids and dispersions of polymers, in order to facilitate coating and/or to impart the desired physical characteristics to the photographic layers. In addition to the light-sensitive layer or layers, the photographic materials can also contain further layers, such as protective layers, filter layers, antihalation layers and further layers containing further constituents which have an effect on the image, such as colour couplers or bleachable dyes.

In the following examples, parts and percentages are by weight, unless stated otherwise.

EXAMPLE 1

A direct-positive emulsion, the mode of action of which is based on the principle of the bleaching of a surface fog, is prepared by subjecting a cubic-mono-disperse silver iodide-bromide emulsion in gelatine, the iodide content of which is 1.6 mol % and the average edge length of the cubic crystals being 0.21 μm, to chemical fogging at a temperature of 60° C. for 2 hours. 7 ml of a 0.01% solution of sodium formaldehyde-sulfoxylate and 14 ml of a 0.01% solution of auric chloride acid ($HAuCl_4$) per mol of silver halide present in the emulsion are used as the fogging agent. A pH value of 8.8 and a pAg value of 6.5 are maintained during the fogging operation.

The emulsion is then treated with a solution of the tri-nuclear cyanine dye of the formula (9), 730 mg of the dye being used per 1 mol of silver halide in the emulsion. The emulsion is then coated onto a polyester substrate, to give a thin, uniform film. The thickness of the layer is set so that one square meter of the layer contains 2.4 g of silver and 3.4 g of gelatine.

A sample of the layer is exposed behind a step wedge in a sensitometer with a conventional tungsten incandescent buld and is developed with a developer of the following composition:

| | |
|---|---|
| N—Methyl-p-aminophenol sulfate | 2.0 g |
| Anhydrous sodium sulfite | 75.0 g |
| Hydroquinone | 8.0 g |
| Anhydrous sodium carbonate | 37.5 g |
| Potassium bromide | 2.0 g |
| Water to make up to 3 liters | |

Evaluation of the exposed and developed step wedge gives the following sensitometric values:

| | |
|---|---|
| Sensitivity $S_{50}$[1] | 1.92 |
| Contrast $\gamma$ | 2.6 |
| $D_{max}$ | 1.64 |
| $D_{min}$ | 0.04 |
| Spectral sensitivity range up to 660 nm | |

[1]in Lux. seconds at 50% of the maximum density, $S_{50} = 3 - \log E$ (E measured in Lux. seconds).

Examples 2, 4 and 5 below show how a supersensitising effect can be produced by the addition of a further sensitiser dye which does not belong to the category of the tri-nuclear cyanines used according to the invention.

EXAMPLE 2

A cubic-monodisperse emulsion of silver iodide-bromide in gelatine, with an iodide content of 1.6 mol % and an edge length of the cubic crystals of 0.28 μm, is fogged with a mixture of sodium formaldehyde-sulfoxylate and auric chloride acid under the same conditions as described in Example 1.

The emulsion thus obtained is divided into three portions and the sensitising dye of the formula (9) and the sensitising dyes of the formulae (24), (25) and (26) are added as indicated in Table I below:

TABLE I

| Dyes of the formula (9) (mg/mol of silver halide) | Additional sensitising dyes (formula) (mg of dye/mol of silver halide) |
|---|---|
| 470 | 130 (24) |
| 470 | 130 (25) |
| 470 | 130 (26) |

The individual emulsions are coated in the manner indicated in Example 1 onto a polyester substrate, so that a layer forms which contains, per square meter, 2.3 g of silver and 3.2 g of gelatine.

A sample from each layer is exposed and then developed as indicated in Example 1. The samples have the sensitomeric data given in Table II below:

TABLE II

| Dyes (formula) | Sensitivity ($S_{50}$) | Contrast ($\gamma$) | $D_{max}$ | $D_{min}$ |
|---|---|---|---|---|
| (9) + (24) | 1.98 | 5.4 | 3.2 | 0.13 |
| (9) + (25) | 1.67 | 7.3 | 3.2 | 0.04 |
| (9) + (26) | 1.85 | 6.3 | 3.1 | 0.04 |

EXAMPLE 3

A direct-positive emulsion is prepared in the same way as in Example 1 except that, in place of the dye of the formula (9), the dye of the formula (10) is used in an amount of 870 mg/mol of silver halide.

The emulsion to which the dye has been added is then coated onto a polyester substrate so that a layer forms which contains, per square meter, 2.4 g of silver and 3.4 g of gelatine. After exposure and development of the layer as indicated in Example 1, the following sensitometric data are measured:

| | |
|---|---|
| Sensitivity $S_{50}$ | 2.08 |
| Contrast $\gamma$ | 1.2 |
| $D_{max}$ | 0.72 |
| $D_{min}$ | 0.02 |
| Sensitivity range up to | 705 nm |

EXAMPLE 4

A direct-positive emulsion is prepared as in Example 1 by fogging a cubic-monodisperse emulsion of silver iodide-bromide in gelatine (1.6 mol % of silver iodide, edge length of the cubes 0.21 μm) at a temperature of 60° C. for 2 hours in the presence of 7 ml of a 0.01% solution of sodium formaldehyde-sulfoxylate and 7 ml of a 0.01% solution of auric chloride acid per mol of silver halide. The pH value is 8.8 and the pAg value is 6.2. The fogged emulsion is divided into 6 portions and the following lyes are added:

TABLE III

| Sensitising dye (formula) (mg/mol of silver halide) | Additional sensitising dye (formula) (mg/mol of silver halide) | |
|---|---|---|
| 730 (9) | | — |
| 600 (9) | 130 | (27) |
| 600 (9) | 130 | (28) |
| 800 (10) | | — |
| 670 (10) | 130 | (27) |
| 670 (10) | 130 | (28) |

The emulsions are coated onto a polyester substrate so that a layer forms which contains, per square meter, 2.4 g of silver and 3.4 g of gelatine.

After exposing and developing as indicated in Example 1, the following sensitometric data are obtained:

TABLE IV

| Dyes (formula) | Sensitivity $S_{50}$ | Contrast ($\gamma$) | $D_{max}$ | $D_{min}$ |
|---|---|---|---|---|
| (9) | 1.44 | 2.2 | 1.38 | 0.04 |
| (9) + (27) | 1.86 | 1.3 | 1.14 | 0.04 |
| (9) + (28) | 1.63 | 2.5 | 1.52 | 0.04 |
| (10) | 1.63 | 5.4 | 3.50 | 0.04 |
| (10) + (27) | 2.20 | 0.8 | 1.50 | 0.05 |
| (10) + (28) | 1.76 | 5.7 | 4.20 | 0.05 |

EXAMPLE 5

A silver iodide-bromide emulsion is prepared in a manner similar to that indicated in Example 2. The emulsion is divided into 13 different portions, which are sensitised in accordance with Table V below with the tri-nuclear cyanine dye of the formula (9) and proportions of the two additional cyanine dyes of the formulae (29) and (24). In this test series, the total amount of sensitiser dye is kept constant at 600 mg per mol of silver halide in the emulsion.

TABLE V

| Dye of the formula (9) (mg/mol of silver halide) | Additional dye (supersensitiser) (mg/mol of silver halide) | |
|---|---|---|
| 600 | 0 | (29) |
| 533 | 67 | (29) |
| 467 | 133 | (29) |
| 400 | 200 | (29) |
| 333 | 267 | (29) |
| 267 | 333 | (29) |
| 200 | 400 | (29) |
| 567 | 33 | (24) |
| 533 | 67 | (24) |
| 500 | 100 | (24) |
| 467 | 133 | (24) |
| 400 | 200 | (24) |
| 333 | 267 | (24) |

The emulsions sensitised in this way are coated onto a polyester substrate to give a layer in which the amount of silver is 2.2 g/m$^2$ and the amount of gelatine is 3.1 g/m$^2$. After drying has been carried out, direct-positive photographic layers are obtained and these are exposed and developed as indicated in Example 1. The sensitometric characteristics are given in Table VI below.

TABLE VI

| Additional dye (formula) (mg/mol of silver halide) | | Sensitivity $S_{50}$ | Contrast $\gamma$ | $D_{max}$ | $D_{min}$ |
|---|---|---|---|---|---|
| 0 | (29) | 0.99 | 7.0 | 3.04 | 0.01 |
| 67 | (29) | 1.07 | 6.1 | 2.50 | 0.01 |
| 133 | (29) | 1.11 | 5.6 | 2.86 | 0.01 |
| 200 | (29) | 1.20 | 4.6 | 2.66 | 0.01 |
| 267 | (29) | 1.28 | 4.0 | 2.56 | 0.01 |
| 333 | (29) | 1.44 | 2.7 | 2.00 | 0.01 |
| 400 | (29) | 1.42 | 3.0 | 2.24 | 0.05 |
| 33 | (24) | 1.16 | 7.1 | 3.14 | 0.01 |
| 67 | (24) | 1.55 | 5.2 | 2.82 | 0.02 |
| 100 | (24) | 1.78 | 4.4 | 2.86 | 0.02 |
| 133 | (24) | 2.18 | 2.8 | 2.80 | 0.03 |
| 200 | (24) | 2.07 | 1.4 | 2.20 | 0.10 |
| 267 | (24) | 1.28 | 1.2 | 2.96 | 0.38 |

The results given in Table VI are plotted graphically in FIG. 3. It can clearly be seen that a considerable increase in the sensitivity can be achieved with an increasing concentration of the additional dye. The additional sensitiser of the formula (29) behaves as a supersensitiser, i.e. the increase in the sensitivity arises in particular as a result of an increase in the originally existing characteristic sensitivity of the trinuclear cyanine dye of the formula (9) at 540 and 600 nm (FIG. 2).

A similar supersensitising effect is found when a dye of the formulae (25), (26), (27), (28), (30), (32) or (33) is used in place of the dyes of the formula (24) or (29).

EXAMPLE 6

This example shows the action of an additional conventional sensitiser which, although it effects an increase in the sensitivity compared with that of the original direct-positive emulsion sensitised with the tri-nuclear cyanine dye, does so only in the characteristic range of the additional dye. In this case, therefore, the sensitising can no longer be regarded as supersensitising but only as normal additional sensitising. A silver iodide-bromide emulsion is fogged as indicated in Example 2 and then divided into 7 portions, which, in addition to the tri-nuclear symmetrical cyanine dye of the formula (9), additionally contain the merocyanine dye of the formula (31) in increasing proportions, the total amount of the two sensitisers being kept at 600 mg per mol of silver halide contained in the emulsion. The amounts are given in Table VII.

TABLE VII

| Dye of the formula (9) (mg/mol of silver halide) | Additional dye of the formula (31) (mg/mol of silver halide) |
|---|---|
| 600 | 0 |
| 533 | 67 |
| 467 | 133 |
| 400 | 200 |
| 333 | 267 |
| 267 | 333 |
| 200 | 400 |

The sensitised emulsions thus obtained are coated as a layer onto a polyester substrate, the layer thickness being such that 3.0 g of gelatine and 2.2 g of silver are present per m$^2$ of the layer. After drying, direct-positive photographic layers are obtained and these are exposed and developed as indicated in Example 1. The sensitometric characteristics are given in Table VIII.

TABLE VIII

| Dye of the formula (9) (mg/mol of silver halide) | Dye of the formula (31) (mg/mol of silver halide) | Sensitivity $S_{50}$ | Contrast $\gamma$ | $D_{max}$ | $D_{min}$ |
|---|---|---|---|---|---|
| 600 | 0 | 0.91 | 7.7 | 3.04 | 0 |
| 533 | 67 | 0.96 | 7.7 | 3.14 | 0 |
| 467 | 133 | 1.01 | 7.7 | 3.14 | 0.01 |
| 400 | 200 | 1.10 | 7.1 | 3.30 | 0.02 |
| 333 | 267 | 1.20 | 7.0 | 2.96 | 0.02 |
| 267 | 333 | 1.18 | 7.0 | 2.04 | 0.03 |
| 200 | 400 | 1.19 | 7.0 | 3.44 | 0.05 |

In this case, the slight increase in the sensitivity (0.28 log E) which is observed does not result from a supersensitising effect but from sensitising by the additional sensitising dye of the formula (31) (FIG. 1).

EXAMPLE 7

In this example two sensitisers are described which give no further increase in sensitivity when used together with the tri-nuclear cyanine dye of the formula (9), i.e. which effect neither a normal additional sensitisation nor a supersensitisation.

A silver iodide emulsion is prepared as described in Example 2. The fogged emulsion is divided into 7 portions, which, in addition to the sensitiser dye of the formula (9), contain proportions of the sensitiser dye of the formula

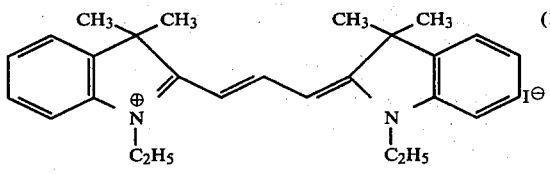

(101)

in increasing amounts, the total amount of the two sensitisers being kept at 600 mg per mol of silver halide contained in the emulsion. The amounts are given in Table IX.

TABLE IX

| Dye of the formula (9) (mg/mol of silver halide) | Dye of the formula (101) (mg/mol of silver halide) |
|---|---|
| 600 | 0 |
| 533 | 67 |
| 467 | 133 |
| 400 | 200 |
| 333 | 267 |
| 267 | 333 |
| 200 | 400 |

The emulsions are coated as layers on a polyester substrate, the layer thickness being such that 2.3 g of silver and 3.2 g of gelatine are present per $m^2$ of the layer. After drying, direct-positive photographic layers are obtained and these are exposed and developed as indicated in Example 1. The sensitometric characteristics are given in Table X.

TABLE X

| Dye of the formula (9) (mg/mol of silver halide) | Dye of the formula (101) (mg/mol of silver halide) | Sensitivity $S_{50}$ | Contrast $\gamma$ | $D_{max}$ | $D_{min}$ |
|---|---|---|---|---|---|
| 600 | 0 | 0.96 | 5.8 | 2.98 | 0.25 |
| 533 | 67 | 1.01 | 6.5 | 3.36 | 0.31 |
| 467 | 133 | 0.92 | 5.8 | 3.42 | 0.30 |
| 400 | 200 | 1.08 | 5.2 | 3.06 | 0.26 |
| 333 | 267 | 1.01 | 5.6 | 3.10 | 0.26 |
| 267 | 333 | 0.96 | 4.7 | 2.86 | 0.17 |
| 200 | 400 | 0.90 | 4.5 | 2.92 | 0.25 |

Table X shows that the sensitivity of the emulsion sensitised with the tri-nuclear cyanine dye of the formula (9) does not undergo any significant change on the addition of the dye of the formula (101) with any of the proportions added.

Similar results are obtained when the dye of the formula

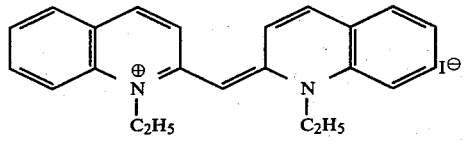

(102)

is used in the place of the dye of the formula (101).

Thus, for example, with a cubic-monodisperse silver iodide-bromide emulsion which has been fogged with sodium formaldehyde-sulfoxylate/sodium tetrachloroaurate the following sensitometric values are obtained after sensitising with 370 mg of the tri-nuclear cyanine dye of the formula (9) per mol of silver halide:

| | |
|---|---|
| Relative sensitivity $S_{50}$ | 1.85 |
| Contrast | 5.1 |
| $D_{max}$ | 2.44 |
| $D_{min}$ | 0.15 |

The values remain virtually unchanged when, for example, 270 mg of the dye of the formula (9) and, in addition, 100 mg of the dye of the formula (102) per mol of silver halide are used for sensitising.

Table XI below shows that a relationship exists between the effect of the various additional sensitisers used in the preceding examples and their polarographically measured anodic half-wave potential:

TABLE XI

| Dye of the formula | Anodic half-wave potential against saturated AgCl (volt) | | Sensitiser effect |
|---|---|---|---|
| (9) | +0.99 | tri-nuclear cyanines of the present invention | direct-positive sensitisers |
| (10) | +1.03 | | |
| (24) | +0.80 | | |
| (25) | +0.80 | | |
| (26) | +0.90 | | |
| (27) | +0.82 | | |
| (28) | not measurable[2] | di-nuclear cyanines | super-sensitisers |
| (29) | +0.90 | | |
| (30) | +1.0 | | |
| (31) | +0.87 | merocyanine | sensitiser |
| (32) | +0.60 | di-nuclear cyanines | super-sensitisers |
| (33) | +0.70 | | |
| (101) | +1.10 | di-nuclear cyanines | no action |
| (102) | +1.03 | | no action |

[2]With this method of measurement, cyanines containing nitro groups do not give a comparable result. c.f. R.F. Large loc. cit.

Table XI shows that the additional sensitiser dyes of the formulae (24) to (33) have a sensitising effect only when the anodic half-wave potentials are smaller than those of the tri-nuclear cyanine dyes which are used as direct-positive sensitisers. The effect in this case can be that of a supersensitiser or, in isolated cases, only that of a normal additional sensitiser which acts in its characteristic absorption range, independently of the sensitising range of the tri-nuclear cyanine dye.

If, on the other hand, the anodic half-wave potential is greater (di-nuclear cyanines of the formulae (101) and (102)) than that of the tri-nuclear cyanine dye, no additional sensitising takes place.

EXAMPLE 8

A direct-positive emulsion is prepared and fogged as described in Example 4. The fogged emulsion is divided into 2 portions and 730 mg of the sensitiser dye of the formula (11) are added to one portion and 730 mg of the sensitiser dye of the formula (12) are added to the other portion.

The emulsions are coated as layers onto a polyester substrate.

After exposing and developing these layers, direct-positive images are obtained which have sensitometric data equivalent to those of the preceding examples.

EXAMPLE 9

This example shows that, in contrast to the cyanine dyes according to the invention, other tri-nuclear cyanine dyes do not produce direct-positive images.

A direct-positive emulsion fogged in accordance with Example 4 is treated with 1,000 mg of the dye of the formula

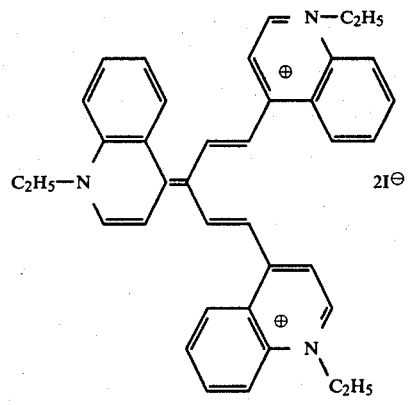

(103)

per mol of silver halide and coated as a layer onto a polyester substrate. The layer contains 2.4 g of silver and 3.4 g of gelatine per $m^2$.

A direct-positive image is not obtained when this layer is exposed behind a step wedge and then developed.

EXAMPLE 10

This example describes the use of tri-nuclear cyanines for light-sensitive, vapour-deposited layers of silver halides.

A 1.2 μm thick layer of a mixture of 95% of silver bromide and 5% of silver iodide is vapour-deposited on a glass slide. The vapour-deposited layer is chemically sensitised by dipping into an aqueous solution containing, per liter, $4.1 \cdot 10^{-5}$ mols of sodium aurous thiosulfate ($Na_3Au(S_2O_3)_2$) and $4.4 \cdot 10^{-5}$ mols of the sodium salt of iridic chloride acid ($Na_2IrCl_6$) and is then uniformly surface-fogged by diffuse exposure to blue light. A 30% aqueous methanol solution which contains $5 \cdot 10^{-5}$ mols of the dye of the formula (9) per liter is then brought in contact with the silver halide layer for two minutes. The layer is then immersed for 30 seconds in an aqueous solution which contains $10^{-2}$ mols of potassium bromide and 2 g of gelatine per liter and is then dried.

An exposure of a step wedge behind two Kodak-Wratten filters is made on this layer using a 1000 watt iodine-tungsten lamp at a distance of 10 centimeters. The exposed vapour-deposited layer is then developed in a conventional N-methyl-p-aminophenol sulfate/hydroquinone developer which contains 26 g of sodium sulfite per liter.

A direct-positive image of the step wedge with a minimum density of 0.60 and a maximum density of 1.50 is obtained on the glass plate.

If the dye of the formula (10) is used in place of the dye of the formula (9), a direct-positive image of the step wedge with a minimum density of 0.30 and a maximum density of 1.55 is obtained.

EXAMPLE 11

A cubic-monodisperse emulsion of silver iodide-bromide in gelatine, with an iodide content of 1.6 mol % and an edge length of the cubic crystals of 0.31μ, is fogged with a mixture of sodium formaldehyde-sulfoxylate and auric chloride acid under the same conditions as described in Example 1. The emulsion thus obtained is divided into 7 portions and these are sensitised in accordance with Table XII below with the tri-nuclear cyanine dye of the formula (13) and proportions of the additional cyanine dye of the formula (24). For this test series the total amount of sensitiser dye is kept constant at 533 mg per mol of silver halide in the emulsion.

The resulting emulsions are coated, exposed and processed as in Example 2. Evaluation of the exposed and developed step wedge gives the following sensitometric values:

TABLE XII

| Dye of the formula (13) (mg/mol of silver halide) | Additional dye of the formula (24) (mg/mol of silver halide) | Sensitivity $S_{50}$ | Contrast | $D_{max}$ | $D_{min}$ |
|---|---|---|---|---|---|
| 533 | 0 | 1.42 | 4.9 | 2.98 | 0.02 |
| 467 | 67 | 1.38 | 6.8 | 3.20 | 0.02 |
| 400 | 133 | 1.70 | 4.8 | 3.08 | 0.03 |
| 333 | 200 | 1.86 | 3.9 | 3.10 | 0.04 |
| 267 | 267 | 1.90 | 2.2 | 2.38 | 0.05 |
| 200 | 333 | 2.08 | 2.2 | 2.40 | 0.05 |
| 133 | 400 | 2.10 | 2.2 | 2.46 | 0.05 |

Spectral sensitivity range up to 745.nm.

EXAMPLE 12

A silver iodide-bromide emulsion is prepared in a manner similar to that indicated in Example 11. The emulsion is divided into 4 different portions and these are sensitised in accordance with Table XIII below with the tri-nuclear cyanine dye of the formula (13) and the sensitising dyes of the formulae (25), (29) and (30).

For this test series the total amount of sensitiser dye is kept constant at 533 mg per mol of silver halide in the emulsion. The resulting emulsions are coated, exposed and processed as in Example 2. The samples have the sensitometric data given in Table XIII below:

TABLE XIII

| Dye of the formula (13) (mg/mol of silver halide) | Additional Dyes (formula) (mg/mol of silver halide) | Sensitivity $S_{50}$ | Contrast | $D_{max}$ | $D_{min}$ |
|---|---|---|---|---|---|
| 533 | 0 | 1.38 | 3.7 | 3.00 | 0.02 |
| 333 | 200 (25) | 1.68 | 5.4 | 2.82 | 0.02 |
| 333 | 200 (29) | 1.76 | 4.2 | 2.74 | 0.06 |
| 400 | 133 (30) | 1.75 | 2.7 | 2.50 | 0.02 |

EXAMPLE 13

Direct-positive emulsions are prepared in the same way as in Example 1 except that dyes of the formula (14) (733 mg/mol of silver halide) and (15) (667 mg/mol of silver halide) are used in place of the dye of the formula (9). The emulsions (edge length of the cubes 0.25 μm) to which the dyes have been added are then coated onto a polyester substrate so that a layer forms which contains 2.0 g of silver and 2.8 g of gelatine per square meter. After exposing and developing the layer as indicated in Example 1, the following sensitometric data are measured:

TABLE XIV

| Dyes (formula) (mg/mol of silver halide) | | Sensitivity $S_{50}$ | Contrast | $D_{max}$ | $D_{min}$ |
|---|---|---|---|---|---|
| 733 | (14) | 1.85 | 1.4 | 2.10 | 0.06 |
| 667 | (15) | 1.68 | 1.2 | 1.50 | 0.02 |

EXAMPLE 14

Direct-positive emulsions are prepared in a manner similar to that in Example 1, except that a pH of 8.8 and a pAg of 6.8 are maintained during the fogging operation and dyes of the formula (16), (567, 667 and 767 mg/mol of silver halide) and (17) (567 and 667 mg/mol of silver halide) are used in place of the dye of the formula (9). The emulsions (edge length of the cubes 0.27 μm) to which the dyes have been added are then coated onto a polyester substrate so that a layer forms which contains 2.0 g of silver and 2.8 g of gelatine per square meter. After exposing and developing the layer as indicated in Example 1, the following sensitometric data are measured:

TABLE XV

| Dyes (formula) (mg/mol of silver halide) | Sensitivity $S_{50}$ | Contrast | $D_{max}$ | $D_{min}$ |
|---|---|---|---|---|
| 567 (16) | 1.44 | 4.5 | 2.96 | 0.01 |
| 667 (16) | 1.50 | 4.8 | 2.86 | 0.01 |
| 767 (16) | 1.50 | 4.8 | 3.14 | 0.01 |
| 567 (17) | 1.61 | 5.9 | 3.04 | 0.02 |
| 667 (17) | 1.69 | 4.9 | 2.70 | 0.02 |

Dye (17) has an excellent spectral sensitivity up to 750 nm.

EXAMPLE 15

A silver iodide-bromide emulsion is prepared in a manner similar to that indicated in Example 14. The emulsion is divided into 4 different portions and these are sensitised in accordance with Table XVI below with the tri-nuclear cyanine dye of the formula (17) and additional proportions of the sensitising dye of the formula (29).

For this test series the total amount of sensitiser dye is kept constant at 533 mg per mol of silver halide in the emulsion. The resulting emulsions are coated, exposed and processed as in Example 14. The samples have the sensitometric data indicated in Table XVI below.

TABLE XVI

| Dye of the formula (17) (mg/mol of silver halide) | Additional dye (24) (mg/mol of silver halide) | Sensitivity $S_{50}$ | Contrast $\gamma$ | $D_{max}$ | $D_{min}$ |
|---|---|---|---|---|---|
| 533 | 0 | 1.69 | 5.3 | 3.20 | 0.02 |
| 467 | 67 | 1.84 | 4.8 | 3.10 | 0.02 |
| 400 | 133 | 1.77 | 3.3 | 3.24 | 0.04 |
| 333 | 200 | 1.64 | 2.6 | 3.20 | 0.10 |

EXAMPLE 16

A direct-positive emulsion according to Example 1 is treated with a solution of the tri-nuclear cyanine dye of the formula (18), 650 mg of the dye being used per 1 mol of silver halide in the emulsion. The emulsion is then coated onto a polyester substrate to give a thin, uniform film. The layer thickness is such that the layer contains 2.4 g of silver and 3.4 g of gelatine per square meter.

A sample of the layer is exposed behind a step wedge in a sensitometer using a conventional tungsten incandescent bulb and developed with a developer of the following composition:

| | |
|---|---|
| N—Methyl-p-aminophenol sulfate | 2.0 g |
| Anhydrous sodium sulfite | 75.0 g |
| Hydroquinone | 8.0 g |
| Anhydrous sodium carbonate | 37.5 g |
| Potassium bromide | 2.0 g |
| Water to make up to 3 liters | |

Evaluation of the exposed and developed step wedge gives the following sensitometric values for the direct-positive image:

| | |
|---|---|
| Sensitivity $S_{50}$(1) | 1.57 |
| Contrast $\gamma$ | 3.2 |
| $D_{max}$ | 2.10 |
| $D_{min}$ | 0.03 |
| Spectral sensitivity range up to 660 nm | |

(1)in Lux. seconds at 50% of the maximum density, $S_{50} = 3 - \log E$ (E measured in Lux. seconds)

EXAMPLE 17

Direct-positive emulsions are prepared in the manner described in Example 16 using the tri-nuclear cyanine dyes of the formula (19), (20), (21) and (22), 600 mg of these dyes per mol of silver halide being employed in each case.

The resulting emulsions are coated onto a polyester substrate to give a thin, uniform film. The layer thickness is such that the layer contains 2.3 g of silver and 3.2 g of gelatine per square meter in each case.

Exposure and development are carried out as described in Example 16.

Evaluation of the exposed and developed step wedge gives the following sensitometric values for the direct-positive images:

TABLE XVII

| Cyanine dye of the formula | Sensitivity ($S_{50}$) | Contrast ($\gamma$) | $D_{max}$ | $D_{min}$ |
|---|---|---|---|---|
| (19) | 1.38 | 3.7 | 3.0 | 0.02 |
| (20) | 1.15 | 5.1 | 2.8 | 0.04 |
| (21) | 1.07 | 4.8 | 2.9 | 0.03 |
| (22) | 1.24 | 4.5 | 2.8 | 0.03 |

The following Examples 18, 19 and 20 show how a supersensitising effect can be produced by the addition of a further sensitiser dye which does not belong to the category of the tri-nuclear cyanines according to the invention.

EXAMPLE 18

A cubic-monodisperse emulsion of silver iodide-bromide in gelatine, with an iodide content of 1.6 mol % and an edge length of the cubic crystals of 0.31 μm, is fogged under the same conditions as described in Example 16 with a mixture of sodium formaldehyde-sulfoxylate and auric chloride acid.

The emulsion thus obtained is divided into three portions and the sensitising dye of the formula (18) and the sensitising dyes of the formulae (34) and (33) are added as indicated in Table XVIII below:

TABLE XVIII

| Dye of the formula (18) (mg/mol of silver halide) | Additional sensitising dyes (formula) (mg/mol of silver halide) |
|---|---|
| 600 | — |
| 400 | 200 dye (34) |
| 400 | 200 dye (33) |

The individual emulsions are coated onto a polyester substrate in the manner indicated in Example 16, so that a layer forms which contains 2.1 g of silver and 3.0 g of gelatine per square meter.

A sample of each layer is exposed and then developed as indicated in Example 16. The samples have the sensitometric data given in Table XIX below:

TABLE XIX

| Dyes (formula) | Sensitivity ($S_{50}$) | Contrast ($\gamma$) | $D_{max}$ | $D_{min}$ |
|---|---|---|---|---|
| (18) | 0.97 | 5.5 | 2.9 | 0.01 |
| (18) + (34) | 1.12 | 5.5 | 2.7 | 0.04 |
| (18) + (33) | 1.23 | 4.5 | 2.9 | 0.15 |

EXAMPLE 19

A silver iodide-bromide emulsion is prepared in a manner similar to that indicated in Example 18. The emulsion is divided into 7 different portions and these are sensitised in accordance with Table XX below with the tri-nuclear cyanine dye of the formula (23) and additional proportions of the additional cyanine dye of the formula (26). For this test series the total amount of sensitiser dye is kept constant at 600 mg per mol of silver halide in the emulsion.

TABLE XX

| Dye of the formula (23) (mg/mol of silver halide) | Additional dye (26) (supersensitiser) (mg/mol of silver halide) |
|---|---|
| 600 | 0 |
| 533 | 67 |
| 467 | 133 |
| 400 | 200 |
| 333 | 267 |
| 267 | 333 |
| 200 | 400 |

The emulsions sensitised in this way are coated onto a polyester substrate to give a layer in which the amount of silver is 2.1 g/m$^2$ and the amount of gelatine is 3.0 g/m$^2$. After drying has been carried out, direct-positive photographic layers are obtained and these are exposed and developed as indicated in Example 16. The sensitometric characteristics are given in Table XXI below.

TABLE XXI

| Additional dye (26) (mg/mol of silver halide) | Sensitivity $S_{50}$ | Contrast $\gamma$ | $D_{max}$ | $D_{min}$ |
|---|---|---|---|---|
| 0 | 1.37 | 4.3 | 2.7 | 0.01 |
| 67 | 1.45 | 3.4 | 2.5 | 0.01 |
| 133 | 1.60 | 3.2 | 2.6 | 0.02 |
| 200 | 1.72 | 3.1 | 2.4 | 0.02 |
| 267 | 1.76 | 2.3 | 1.9 | 0.03 |
| 333 | 1.78 | 1.9 | 1.7 | 0.03 |
| 400 | 1.88 | 1.7 | 1.6 | 0.03 |

The additional sensitiser of the formula (26) behaves as a supersensitiser, i.e. the increase in the sensitivity results in particular from an increase in the originally existing characteristic sensitivity of the tri-nuclear cyanine dye of the formula (23).

EXAMPLE 20

A direct-positive emulsion is prepared as in Example 16 by fogging a cubic-monodisperse emulsion of silver iodide-bromide in gelatine (1.6 mol % of silver iodide, edge length of the cubes 0.25 μm) at a temperature of 60° C. for 100 minutes in the presence of 7 ml of a 0.01% solution of sodium formaldehyde-sulfoxylate and 13 ml of a 0.01% solution of auric chloride acid per mol of silver halide. The pH value is 8.8 and the pAg value is 6.5. The fogged emulsion is divided into 5 portions and the following dyes are added:

TABLE XXII

| Sensitising dye (20) (mg/mol of silver halide) | Additional sensitising dye (formula) (mg/mol of silver halide) |
|---|---|
| 730 | — |
| 530 | 200 (25) |
| 330 | 400 (25) |
| 600 | 130 (30) |
| 460 | 270 (30) |

The emulsions are coated onto a polyester substrate so that a layer forms which contains 2.1 g of silver and 3.0 g of gelatine per square meter.

After exposing and developing as indicated in Example 16, the following sensitometric data are obtained for the resulting direct-positive images:

TABLE XXIII

| Sensitising dye of the formula (20) (mg/mol of silver halide) | Additional dye (formula) (mg/mol of silver halide) | Sensitivity $S_{50}$ | Contrast $\gamma$ | $D_{max}$ | $D_{min}$ |
|---|---|---|---|---|---|
| 730 | — | 1.20 | 6.5 | 3.0 | 0.03 |
| 530 | 200 (25) | 1.30 | 6.5 | 3.2 | 0.05 |
| 330 | 400 (25) | 1.45 | 4.0 | 2.9 | 0.15 |
| 600 | 130 (30) | 1.25 | 5.5 | 3.1 | 0.03 |
| 460 | 270 (30) | 1.32 | 5.0 | 3.1 | 0.02 |

EXAMPLE 21

A silver iodide-bromide emulsion is prepared in a manner similar to that indicated in Example 20. The emulsion thus obtained is treated with a solution of the cyanine dye of the formula (21), 533 mg of the dye being used per 1 mol of silver halide in the emulsion.

The emulsion is then coated onto a polyester substrate so that a layer forms which contains 2.1 g of silver and 2.6 g of gelatine per square meter. After exposure and development of the layer as indicated in Example 16, the following sensitometric data are measured:

| | |
|---|---|
| Sensitivity $S_{50}$ | 0.84 |
| Contrast $\gamma$ | 3.6 |
| $D_{max}$ | 3.02 |
| $D_{min}$ | 0.03 |

EXAMPLE 22

A silver iodide-bromide emulsion is prepared in a manner similar to that indicated in Example 20. The emulsion is divided into 4 different portions and these are sensitised in accordance with Table XXIV below with the tri-nuclear cyanine dye of the formula (21), and additional proportions of the sensitising dye of the formula (31).

For this test series the total amount of sensitiser dye is kept constant at 533 mg per mol of silver halide in the emulsion. The resulting emulsions are coated, exposed and processed as in Example 21. The samples have the sensitometric data given in Table XXIV below.

TABLE XXIV

| Dye of the formula (21) (mg/mol of silver halide) | Additional dye (31) (mg/mol of silver halide) | Sensitivity $S_{50}$ | Contrast $\gamma$ | $D_{max}$ | $D_{min}$ |
|---|---|---|---|---|---|
| 533 | 0 | 0.85 | 5.1 | 3.36 | 0.02 |
| 433 | 100 | 0.95 | 5.1 | 3.44 | 0.04 |
| 333 | 200 | 1.13 | 4.6 | 3.32 | 0.03 |
| 233 | 300 | 1.01 | 4.7 | 3.22 | 0.05 |

What is claimed is:

1. A direct-positive photographic material having at least one layer which contains a silver halide emulsion surface-fogged by chemical means or by exposure and a cyanine dye, wherein the dye has the formula

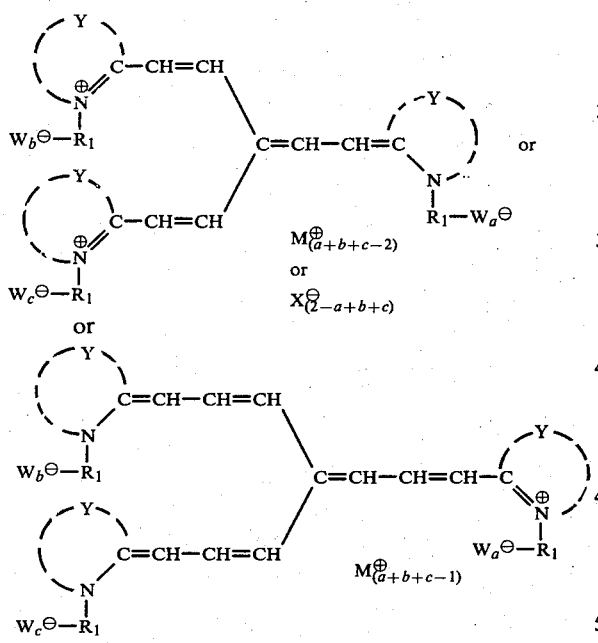

in which Y represents the atoms necessary to complete the mono- or poly-heterocyclic ring system, $R_1$ in each case is a substituted or unsubstituted alkyl having 1 to 20 carbon atoms, aryl or aralkyl (if $W^{\ominus}$ is not present), substituted or unsubstituted alkylene having 1 to 20 carbon atoms or substituted or unsubstituted aryl or aralkyl, $W^{\ominus}$ is a sulfo or carboxyl group, $M^{\oplus}$ is a monovalent cation, $X^{\ominus}$ is a monovalent anion and a, b and c are each the number 0 or 1, one of these indices being 1, said dye being present in an amount sufficient to increase the sensitivity of the emulsion in the long-wave regions of visible light.

2. A direct-positive photographic material according to claim 1, which also contains, in at least one light-sensitive, silver halide-containing layer, at least one further spectral sensitizing dye which has the formula

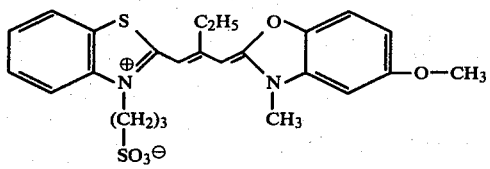

3. A direct-positive photographic material according to claim 1, wherein Y represents the atoms necessary to complete the mono- or poly-heterocyclic ring system of the formula

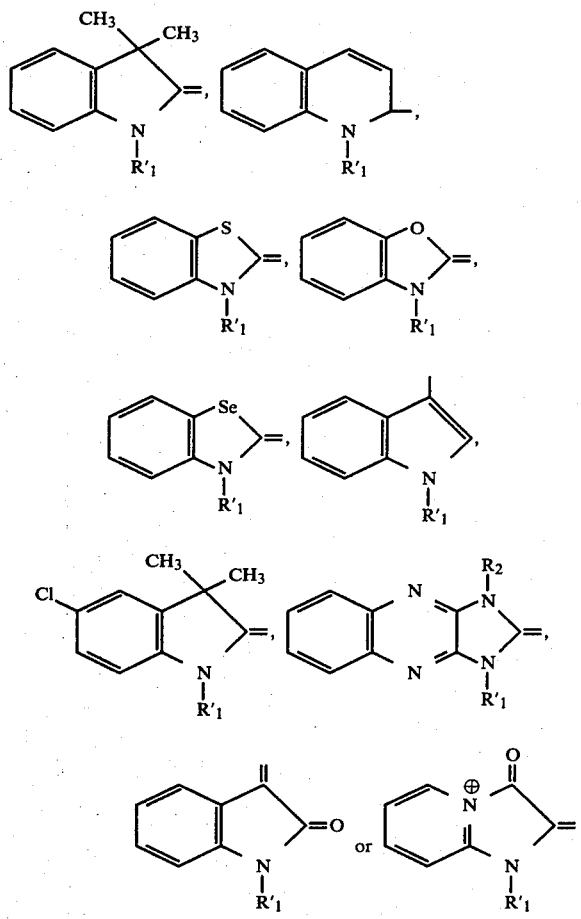

and in which $R_1'$ is substituted or unsubstituted alkyl or aryl and $R_2$ is alkyl having 1 to 4 carbon atoms.

4. A direct-positive photographic material according to claim 3, wherein $R_1'$ and $R_2$ are each alkyl having 1 to 4 carbon atoms or phenyl.

5. A direct-positive photographic material according to claim 1, wherein Y represents the atoms necessary to complete the mono- or poly-heterocyclic ring system of the formula

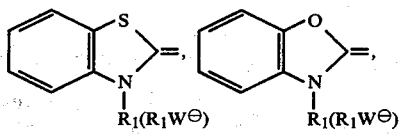

-continued

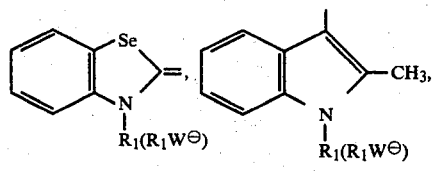

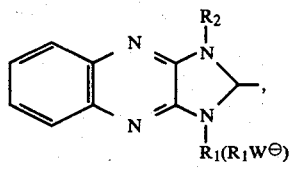

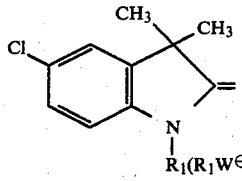

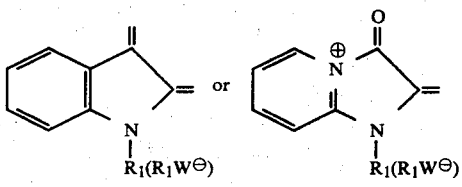

in which $R_1$ is a substituted or unsubstituted alkyl having 1 to 20 carbon atoms, aryl or aralkyl (if $W^{\ominus}$ is not present), substituted or unsubstituted aryl or aralkyl, $W^{\ominus}$ is a sulfo or carboxyl group and $R_2$ is alkyl having 1 to 4 carbon atoms.

6. A direct-positive photographic material according to claim 5, wherein $R_1$ is methyl, ethyl, n-propyl, n-butyl, iso-butyl, allyl, β-methallyl, β-methoxyethyl, β-ethoxyethyl, β-hydroxyethyl, γ-hydroxypropyl, benzyl, β-phenylethyl, carboxymethyl, carboxyethyl, carboxypropyl, carboxybutyl, sulfoethyl, sulfopropyl, sulfobutyl, p-sulfobenzyl, carbomethoxy-methyl or -ethyl or carboethoxymethyl or -ethyl.

7. A direct-positive photographic material according to claim 1, wherein the cyanine dye is a tri-nuclear symmetrical cyanine dye of the formula

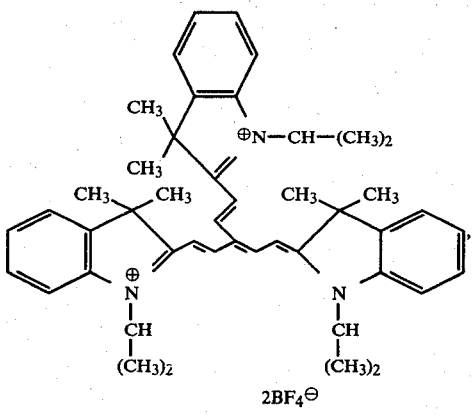

-continued (13)

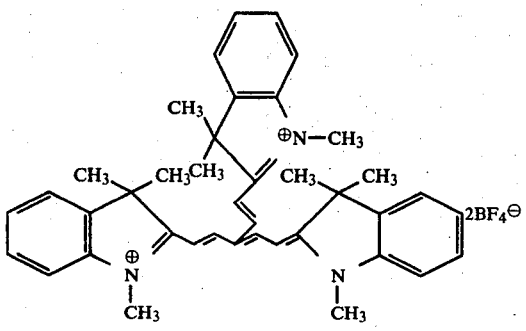

(14)

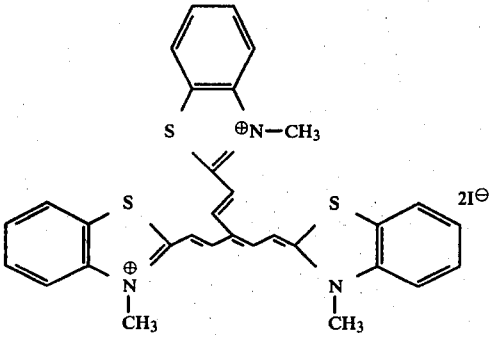

(15)

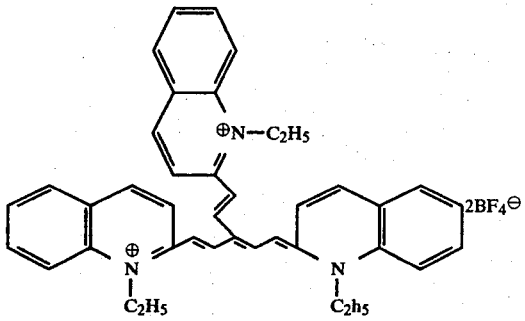

or (17)

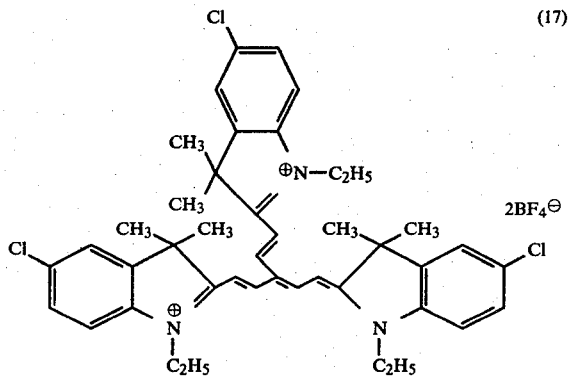

8. A direct-positive photographic material according to claim 1, wherein the tri-nuclear cyanine dye has the formula

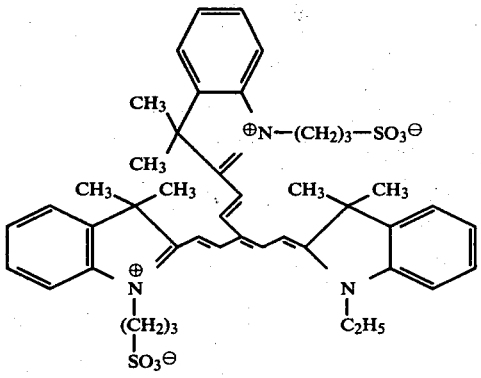
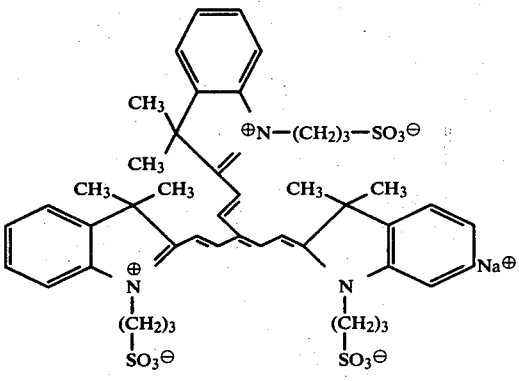
-continued
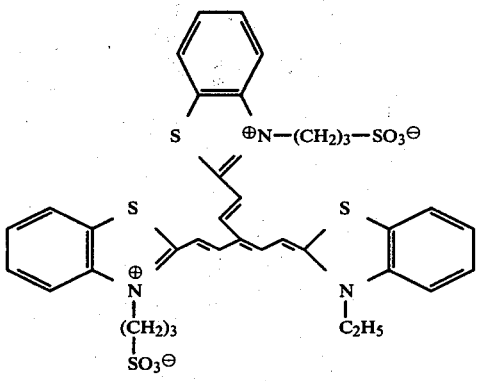
or
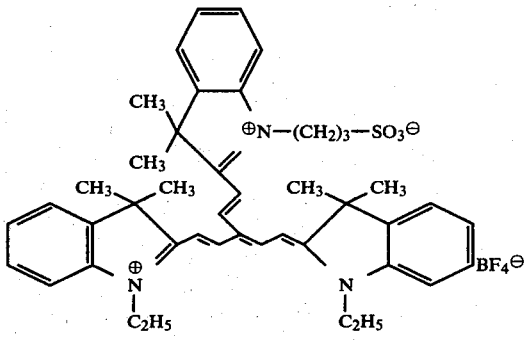
* * * * *

UNITED STATES PATENT AND TRADEMARK OFFICE

CERTIFICATE OF CORRECTION

PATENT NO. : 4,376,817

DATED : Mar. 15, 1983

INVENTOR(S) : Rolf Steiger et al

It is certified that error appears in the above-identified patent and that said Letters Patent are hereby corrected as shown below:

Column 1, line 5 Delete "29" and insert --28--.

Signed and Sealed this

Ninth Day of August 1983

[SEAL]

*Attest:*

GERALD J. MOSSINGHOFF

*Attesting Officer*

*Commissioner of Patents and Trademarks*